US009127431B2

(12) United States Patent
Lanham et al.

(10) Patent No.: US 9,127,431 B2
(45) **Date of Patent: *Sep. 8, 2015**

(54) MANHOLE SECURITY COVER

(75) Inventors: Thomas Lanham, Boston, NY (US); Wayne Hemmerling, Orchard Park, NY (US); Andrew Trank, Orchard Park, NY (US); Daniel Corby, Colden, NY (US); Jeffrey Sullivan, Boston, NY (US); Eric Nolle, South Wales, NY (US)

(73) Assignee: McGard LLC, Orchard Park, NY (US)

( * ) Notice: Subject to any disclaimer, the term of this patent is extended or adjusted under 35 U.S.C. 154(b) by 154 days.

This patent is subject to a terminal disclaimer.

(21) Appl. No.: 13/878,112

(22) PCT Filed: Jun. 8, 2011

(86) PCT No.: PCT/US2011/039641

§ 371 (c)(1),
(2), (4) Date: Apr. 8, 2013

(87) PCT Pub. No.: WO2012/047321

PCT Pub. Date: Apr. 12, 2012

(65) Prior Publication Data

US 2013/0212945 A1 Aug. 22, 2013

Related U.S. Application Data

(63) Continuation-in-part of application No. 12/900,227, filed on Oct. 7, 2010, now Pat. No. 8,888,400, and a continuation-in-part of application No. 12/974,271, filed on Dec. 21, 2010, now Pat. No. 8,674,830.

(51) Int. Cl.

| | |
|---|---|
| ***G08B 21/00*** | (2006.01) |
| ***E02D 29/14*** | (2006.01) |
| ***E05F 15/20*** | (2006.01) |

(52) U.S. Cl.

CPC ..... *E02D 29/1427* (2013.01); *E05F 15/2076* (2013.01)

(58) Field of Classification Search

CPC ..... E02D 29/1427; G08B 13/00

USPC ..... 340/540

See application file for complete search history.

(56) References Cited

U.S. PATENT DOCUMENTS

| | | | |
|---|---|---|---|
| 1,287,290 | A | 12/1918 | Golden |
| 1,400,399 | A | 12/1921 | Yaeche |

(Continued)

FOREIGN PATENT DOCUMENTS

| | | |
|---|---|---|
| EP | 2187174 | 5/2010 |
| GB | 2257736 A | 1/1993 |

OTHER PUBLICATIONS

"The LockDown System," LockDown-LockDry Division, Barton Southern Company, Inc., Apr. 2005, 1 page.

(Continued)

*Primary Examiner* — Kerri McNally
(74) *Attorney, Agent, or Firm* — Walter W. Duft

(57) ABSTRACT

A manhole security cover includes a manhole cover body comprising a non-metallic RF signal transmissive material. The manhole cover body is seatable on a manhole frame to cover a manhole opening. In the seated position, the first side is accessible from outside the manhole, the second side is disposed within the manhole, and the peripheral edge portion engages a manhole cover support surface on the manhole frame. A manhole cover tamper sensor is responsive to a predetermined movement of the manhole security cover body. A transmitter is operatively connected to the manhole cover tamper sensor and configured to generate a radio frequency manhole cover tamper signal when the manhole cover tamper sensor detects the predetermined movement of the manhole security cover body. An antenna is operatively coupled to the transmitter to radiate radio frequency energy through the manhole cover body to a receiver located outside of said manhole.

17 Claims, 21 Drawing Sheets

(56) References Cited

U.S. PATENT DOCUMENTS

| | | | | |
|---|---|---|---|---|
| 1,458,391 | A | 6/1923 | Burton | |
| 2,363,567 | A | 11/1944 | Blakeman | |
| 3,772,828 | A | 11/1973 | Chahley | |
| 3,797,286 | A | 3/1974 | Saporito | |
| 3,837,622 | A | 9/1974 | Gale | |
| 4,101,154 | A | 7/1978 | Kagstrom | |
| 4,369,437 | A | 1/1983 | Thompson, Jr. et al. | |
| 4,577,478 | A | 3/1986 | Economopoulos et al. | |
| 4,723,866 | A | 2/1988 | McCauley | |
| 4,902,165 | A | 2/1990 | Embree | |
| 4,964,755 | A | 10/1990 | Lewis et al. | |
| 5,070,564 | A | 12/1991 | Fey | |
| 5,082,392 | A | 1/1992 | Marchese et al. | |
| 5,328,291 | A | 7/1994 | Wisniewski | |
| 5,821,864 | A | 10/1998 | Knop et al. | |
| 5,827,007 | A | 10/1998 | Barton et al. | |
| 5,987,824 | A | 11/1999 | Fuller | |
| 6,550,294 | B2 | 4/2003 | Garguilo | |
| 6,739,796 | B1 | 5/2004 | Del Nero et al. | |
| 6,881,007 | B2 | 4/2005 | Dennis | |
| 7,002,481 | B1 * | 2/2006 | Crane et al. | 340/618 |
| 7,154,866 | B2 | 12/2006 | Shurmantine et al. | |
| 7,201,533 | B2 | 4/2007 | DeGreef | |
| 7,201,534 | B2 | 4/2007 | Dennis | |
| 7,243,515 | B2 | 7/2007 | Meyer | |
| 7,292,143 | B2 | 11/2007 | Drake et al. | |
| 7,347,070 | B1 | 3/2008 | Spector | |
| 7,484,909 | B2 | 2/2009 | Brady et al. | |
| 7,554,932 | B1 | 6/2009 | Shurmantine et al. | |
| 7,792,126 | B1 | 9/2010 | Montestruque et al. | |
| 8,217,790 | B2 | 7/2012 | Script | |
| 8,289,184 | B2 | 10/2012 | Strom | |
| 2001/0011009 | A1 | 8/2001 | Harada et al. | |
| 2006/0261941 | A1 * | 11/2006 | Drake et al. | 340/539.26 |
| 2007/0109097 | A1 | 5/2007 | Coutermarch et al. | |
| 2008/0256997 | A1 | 10/2008 | Nolle et al. | |
| 2008/0260460 | A1 | 10/2008 | Nolle et al. | |
| 2009/0255183 | A1 | 10/2009 | Nolle et al. | |
| 2010/0019912 | A1 | 1/2010 | Wander | |
| 2010/0156632 | A1 | 6/2010 | Hyland et al. | |

OTHER PUBLICATIONS

"Manhole Protection Underground Infrastructure Security," Manhole Barrier Security Security Systems, Inc., 2006, 4 pages.

T. Lanham, "Declaration of Thomas R. Lanham Under 37 C.F.R. 1.56", Aug. 2011, 25 pages.

"Comcore Manhole Antenna Covers", Elan Technologies, Inc., Jan. 2008, 2 pages.

T. Ruggaber, "Getting Real with CSO", Water & Wastes Digest, Jul. 1, 2008, pp. 18-19.

M. Lemmon et al., "Embedded Network Technology in Environmental Science and Engineering", Jan. 31, 2006, 24 pages.

T. Ruggaber, "High Density CSO Monitoring Using an Embedded Sensor Network in South Bend, IN", Dec. 2007, 16 pages.

Inovonics, "RF Modules", Datasheet, Nov. 11, 2009, 2 pages.

Inovonics, "Universal Transmitters", Datasheet, Nov. 11, 2009, 4 pages.

Inovonics, "Using an EchoStream RF Module with an Add-On Receiver", May 26, 2006, 4 pages.

WIPO, "International Search Report and Written Opinion of International Searching Authority", counterpart International Application No. PCT/US2011/039641, Feb. 23, 2012, 8 pages.

* cited by examiner

MANHOLE SECURITY COVER

BACKGROUND

1. Field

The present disclosure relates to apparatus for securing access to manhole openings. More particularly, the disclosure concerns a manhole security cover.

2. Description of Prior Art

By way of background, standard manholes are designed to be easily removed from manhole openings to allow access to underground or aboveground facilities such as sewers, equipment vaults for electrical, communication and/or utility power systems, storage tanks and towers, and other infrastructure. This presents a security risk by allowing vandals, terrorists and others to gain unauthorized access to important assets, or to move about undetected via underground passageways. Standard manhole covers are also attractive targets for thieves who sell the covers for their scrap metal value. It is to improvements in manhole opening security that the present disclosure is directed.

SUMMARY

A manhole security cover includes a manhole cover body comprising a non-metallic RF signal transmissive material and having a generally planar first side, a second side spaced from the first side and a peripheral edge portion. The manhole cover body is seatable on a manhole frame in order to cover a manhole opening. In the seated position of the manhole cover body, its first side is accessible from outside the manhole, its second side is disposed within the manhole, and its peripheral edge portion engages a manhole cover support surface on the manhole frame. A manhole cover tamper sensor is responsive to a predetermined movement of the manhole security cover body. A transmitter is operatively connected to the manhole cover tamper sensor and configured to generate a radio frequency manhole cover tamper signal when the manhole cover tamper sensor detects the predetermined movement of the manhole security cover body. An antenna is operatively coupled to the transmitter to radiate radio frequency energy through the manhole cover body to a receiver located outside of the manhole.

According to one example embodiment, the transmitter and the antenna may be disposed in a transmitter housing on the second side of the manhole cover body. The transmitter housing provides modularity and may be security-enhanced by providing a transmitter housing tamper sensor to protect the transmitter and the antenna against unauthorized access.

According to another example embodiment, the manhole security cover includes a latch mechanism having one or more latches and a precision mounting insert for installing and latching the manhole security cover on the manhole frame. The precision mounting insert may be provided with one or more control surfaces, including a latching control surface configured to engage the latches and maintain the manhole cover body in a defined home position relative to the manhole frame that may assist in tamper sensing.

According to a further example embodiment, the manhole security cover includes a latch mechanism having one or more latches and a latch sensor that is responsive to the latch mechanism being unlatched to generate an unlatching signal. The manhole cover tamper sensor and the latch sensor may be used to support a two-stage alert wherein receipt of the unlatching signal within a predetermined time period prior to receipt of the manhole cover tamper signal enables a determination of whether removal of the manhole security cover from the manhole opening is authorized.

According to a further example embodiment, the manhole security cover includes a latch mechanism having one or more latches and an electromechanical latch actuator. The electromechanical latch actuator is operable to support keyless entry to the manhole by automatically unlatching the latch mechanism, and/or is operable to support two-stage entry to the manhole by automatically unlocking the latch mechanism so that it can be operated by a mechanical key. A wireless receiver is operatively coupled to the latch actuator and configured to control the actuator to unlatch or unlock the latch mechanism in response to a latch mechanism wireless control signal received by the receiver from outside the manhole. The receiver may be separate from the transmitter that generates the manhole cover tamper signal, or it may be combined with the transmitter in a transmitter/receiver. A short-range wireless receiver may be added for authenticating a mechanical key that supports wireless key identification.

According to a further example embodiment, the transmitter, the antenna and the manhole cover tamper sensor are disposed within a single transmitter/antenna/sensor (TAS) unit on the second side of the manhole cover body. The manhole cover tamper sensor may employ electronic movement and/or positioning technology. Logic may be provided within the TAS unit for distinguishing between actual manhole cover tamper events and non-tamper-related events. The manhole security cover may include a latch mechanism having one or more latches and the TAS unit may be mounted to the latch mechanism in order to minimize false alarms caused by normal cover deflections. A sensor may be provided to monitor such cover deflections. The TAS unit may be mounted at a location on the latch mechanism that is proximate to a moving latch mechanism component in order to detect such movement and generate an unlatching signal. This will support a two-stage alert as mentioned above wherein receipt of the unlatching signal within a predetermined time period prior to receipt of the manhole cover tamper signal enables a determination of whether removal of the manhole security cover from the manhole opening is authorized.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Introduction

Figure 1:
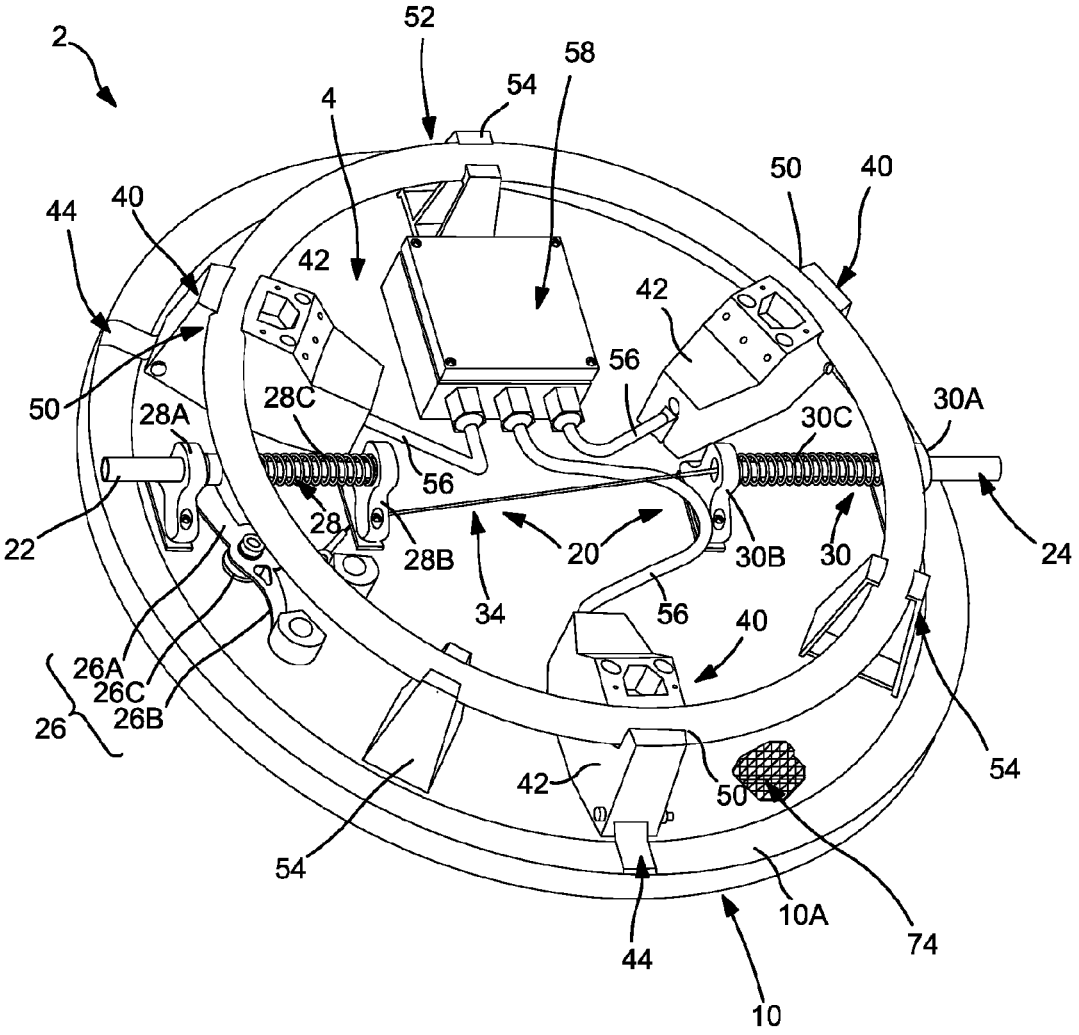
FIG. 1 is a perspective view showing a manhole security cover according to an example embodiment.

The present disclosure is directed to a manhole security cover for covering a manhole opening that provides access to underground or aboveground facilities such as sewers, equipment vaults for electrical, communication and/or utility power systems, storage tanks and towers, and other infrastructure. The manhole security cover includes a manhole cover body and in example embodiments may further include a mechanical latch mechanism having one or more latches. One or more sensors and wireless technology are provided on the underside of the manhole cover body to provide remote detection of manhole security cover tampering, such as when the manhole security cover is lifted or removed. The sensor(s) may comprise mechanical switches of various design as well as other types of sensing devices, such as proximity sensors, tilt sensors, position sensors, inertial sensors, vibration sensors, infrared sensors, etc. The wireless technology may be provided by a self-contained radio frequency (RF) transmitter/antenna unit. RF wireless signals are transmitted through the manhole cover body, which may comprise a non-metallic composite material that allows the passage of RF radiation. The manhole security cover may be enhanced with one or more additional features that improve its operational characteristics.

One such enhancement is to construct the transmitter/antenna unit as a modular device that is protected in a secure transmitter housing. Advantageously, the transmitter/antenna unit may be easily replaced for upgrade and/or repair, and cannot be easily disabled without triggering a security alert.

Another enhancement is to provide a precision mounting insert to facilitate installation of the manhole security cover on a manhole frame. Advantageously, the precision mounting insert may be formed with one or more control surfaces, including a latching control surface configured to engage the manhole security cover's latches and maintain the manhole cover body in a defined home position relative to the manhole frame in order to assist in tamper sensing.

A further enhancement is to provide a latch sensor that is responsive to the manhole security cover's latch mechanism being unlatched to generate an unlatching signal. The latch sensor may be used in conjunction with the manhole cover tamper sensor to support a two-stage alert system and method wherein receipt of the unlatching signal within a predetermined time period prior to receipt of the manhole cover tamper signal enables a determination of whether removal of the manhole security cover from the manhole opening is authorized.

A further enhancement is to provide an electromechanical latch actuator. The electromechanical latch actuator is operable to support a system and method for keyless entry to the manhole by automatically unlatching the manhole security cover's latch mechanism, and/or is operable to support a system and method for two-stage entry to the manhole by automatically unlocking the latch mechanism so that it can be operated by a mechanical key. A wireless receiver unit may be operatively coupled to the latch actuator and configured to control the actuator to unlatch or unlock the latch mechanism in response to a latch mechanism wireless control signal received by the receiver from outside the manhole. The receiver may be separate from the transmitter that generates the manhole cover tamper signal, or it may be combined with the transmitter in a transmitter/receiver. A short-range wireless receiver may be added for authenticating a mechanical key that supports wireless key identification.

According to a still further enhancement, the transmitter, the antenna and the manhole cover tamper sensor are disposed within a single transmitter/antenna/sensor (TAS) unit on the second side of the manhole cover body. The manhole cover tamper sensor may employ electronic movement and/or positioning technology. Logic may be provided within the TAS unit for distinguishing between actual manhole cover tamper events and non-tamper-related events. The manhole security cover may include a latch mechanism having one or more latches and the TAS unit may be mounted to the latch mechanism in order to minimize false alarms caused by normal cover deflections. A sensor may be provided to monitor such cover deflections. The TAS unit may be mounted at a location on the latch mechanism that is proximate to a moving latch mechanism component in order to detect such movement and generate an unlatching signal. This will support a two-stage alert as mentioned above wherein receipt of the unlatching signal within a predetermined time period prior to receipt of the manhole cover tamper signal enables a determination of whether removal of the manhole security cover from the manhole opening is authorized.

Example Embodiments

Figure 2:
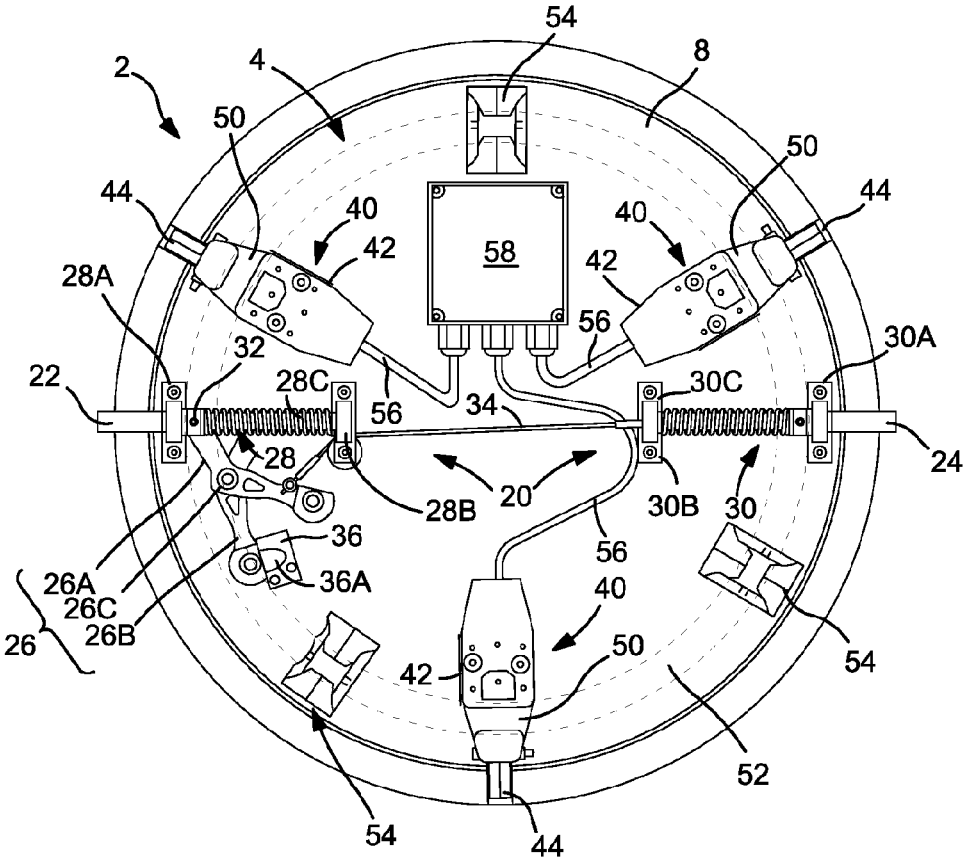
FIG. 2 is a plan view of the manhole security cover of FIG. 1.
Figure 3:
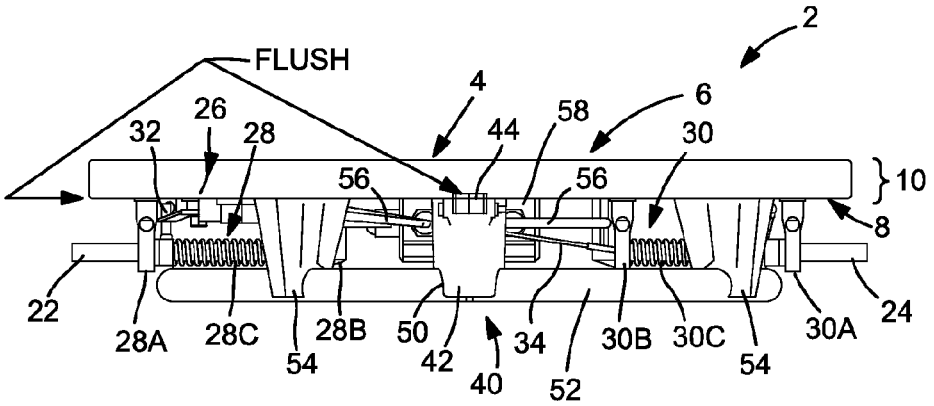
FIG. 3 is a side view of the manhole security cover of FIG. 1.

Turning now to FIGS. 1-3, a manhole security cover 2 according to an example embodiment is illustrated. The manhole security cover 2 includes a manhole cover body 4 that is constructed substantially entirely from a non-metallic RF signal transmissive material, such as a fiber resin composite. Examples of such composites include, but are not limited to, graphite epoxy composites, fiberglass composites, and other fiber resin systems. As best shown in FIG. 3, the manhole cover body 4 has a generally planar first side 6, a second side 8 spaced from the first side and a peripheral edge portion 10. The second side 8 is shown as being generally planar, like the first side 6. However, the second side 8 could also have other shapes, such as a convex or concave configuration. As can be seen in FIG. 2, the manhole cover body is substantially circular. However, non-circular shapes may also be used.

Figure 4:
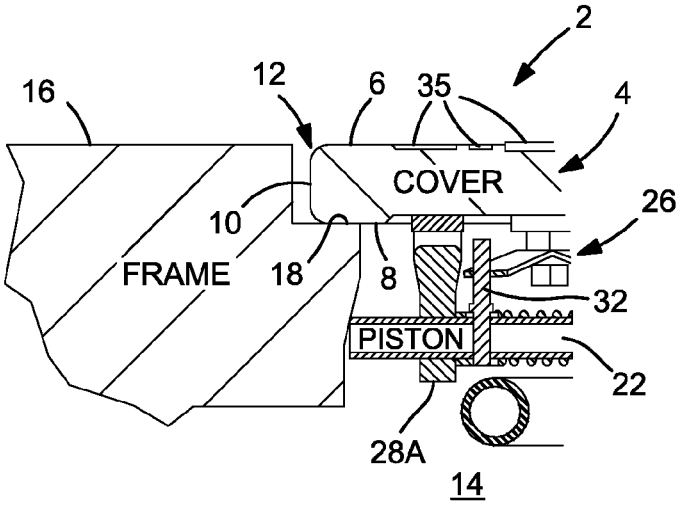
FIG. 4 is a partial cross-sectional view showing a manhole frame mounting the manhole security cover of FIG. 1.

With additional reference now to FIG. 4, the manhole security cover 2 is shown in an example installation covering an opening 12 to a manhole 14. In the illustrated installation, the manhole cover body 4 is seated on a manhole frame 16 of conventional design. In the seated position of the manhole cover body 4, its first side 6 is accessible from outside the manhole 14, its second side 8 is disposed within the manhole 14, and its peripheral edge portion 10 engages a manhole cover support surface 18 on the manhole frame 16 (typically formed as a manhole frame ring flange). As shown in FIG. 1, the peripheral edge portion 10 of the manhole cover body 4, or at least the underside thereof, may be provided with a protective gasket 10A comprising a durable polymer material. The protective gasket 10A will engage the manhole cover support surface 18 and protect the peripheral edge portion 10 from abrasion.

If desired, the thickness of the manhole cover body 4 can be increased around its peripheral edge portion 10 (relative to its interior region) for added structural rigidity. This increased thickness can be seen in FIG. 4 where the manhole cover body 4 engages the manhole cover support surface 18. FIG. 4 also shows that the first side 6 of the manhole cover body 4 will typically be substantially flush with the top the manhole frame 16 and a surrounding surface (not shown) in which the manhole frame is situated (e.g., a roadway, walkway, parking lot, etc.).

The manhole security cover 2 may further include a suitable latch mechanism for locking or otherwise securing the manhole cover body 4 to the manhole frame 16. By way of example only, a latch mechanism 20 (see FIGS. 1-3) may be provided in accordance with the self-locking manhole cover design shown and described in FIGS. 13-14 of commonly-owned U.S. patent application Ser. No. 12/125,663 (the "'663 application"), entitled "Self-Locking Manhole Cover." The entire contents of the '663 application are hereby incorporated herein by this reference. According to this design, the latch mechanism 20 may include a pair of retractable latches 22 and 24 that are driven by a rotatable latch drive unit 26. The latches 22 and 24 may be configured as slidable locking pistons. Alternatively, as shown and described in FIGS. 1-12 of the '663 application, one of the latches could be a fixed anchor member while the other is retractable.

The latches 22 and 24 are arranged to engage diametrically opposing locations on the manhole frame 16. If desired, additional latches could be added to engage the manhole frame 16 at other locations. In a typical construction of the manhole frame 16, the latches 22 and 24 will engage the inside wall of manhole frame at a location that is below the manhole cover support surface 18. This engagement is shown in FIG. 4.

Figure 5:
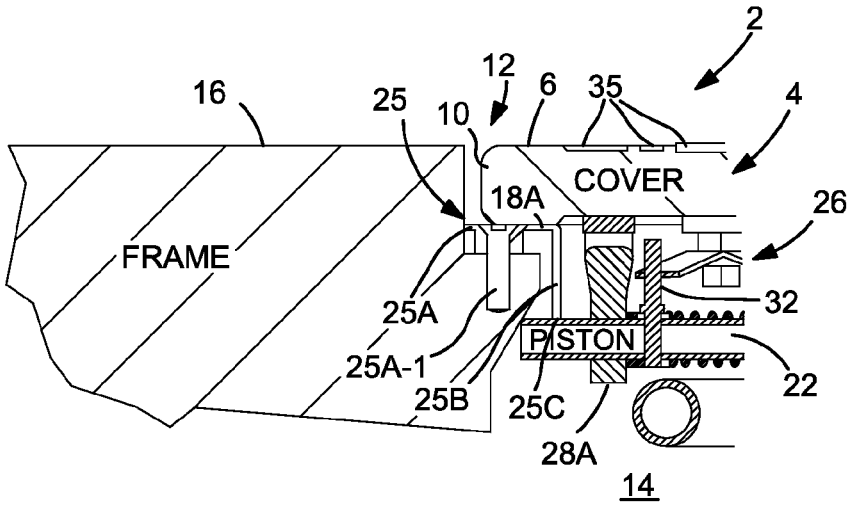
FIG. 5 is a partial cross-sectional view showing a manhole frame with a precision mounting insert mounting the manhole security cover of FIG. 1.

In an alternative configuration shown in FIG. 5, the latches 22 and 24 do not directly engage the manhole frame 16. Instead, the latches 22 and 24 engage a precision mounting insert 25 that is itself securely attached to the manhole frame 16. The precision mounting insert 25 may be configured as a rolled angle frame whose size and shape conforms to the size and shape of the topmost portion of the manhole opening 12. In the illustrated embodiment, the mounting insert 25 is ring-shaped due to the manhole opening 12 having a circular configuration.

The precision mounting insert 25 includes a first upper portion 25A that may be configured as a generally horizontal flange element having a flat upper surface. The first portion 25A is fastened or otherwise secured to the manhole cover support surface 18 of the manhole frame using screws 25A-1 or other fasteners. Welding could also be used. The precision mounting insert 25 further includes a second lower portion 25B that may be configured as a generally vertical flange element. The second portion 25B extends obliquely (e.g. perpendicularly) from the first portion 25A. In the illustrated embodiment, the second portion 25B extends downwardly away from the manhole opening 12. In this configuration of the precision mounting insert 25, the flat upper surface of the first portion 25A provides an alternate manhole cover support surface 18A that supports the manhole cover body 4. The bottom edge of the second portion 25B provides a latching control surface 25C that is configured to be engaged by the latches 22 and 24. The latching control surface 25C provides a defined edge that the latches 22 and 24 will affirmatively engage. The distance from the top of the precision mounting insert 25 (i.e., the alternative manhole cover support surface 18A) to the bottom edge of the second portion 25B of the precision mounting insert 25 (i.e., the latching control surface 25C) may be chosen to closely match the spacing between the second side 8 of the manhole cover body 4 (at the peripheral edge portion 10) and the top of the latches 22 and 24. This will ensure that the manhole security cover 2 will always be securely engaged on the manhole frame 16 in a defined home position so as to facilitate accurate manhole cover tamper sensing and movement detection. Without the precision mounting insert 25, it might be possible in some manhole frames for overhead traffic to flex or move the manhole cover body 4 relative to the frame in a manner that is not conducive to accurate security sensing. In an alternative configuration of the precision mounting insert 25, a gap may be left between the latching control surface 25C and the latches 22 and 24. This will allow the manhole security cover 2 to detect a prying attempt in which the manhole cover body 4 is lifted enough to trigger a manhole cover tamper signal before the latches 22 and 24 engage the latching control surface 25C and prevent complete lift out. This configuration would also allow the manhole security cover 2 to detect explosions that occur underground at the manhole site. The manhole cover body 4 would likely lift up during an explosion, generate a manhole cover tamper signal, and the re-seat after the manhole cover body's upward movement is stopped by the latches 22 and 24 engaging the latching control surface 25C.

Figure 5A:
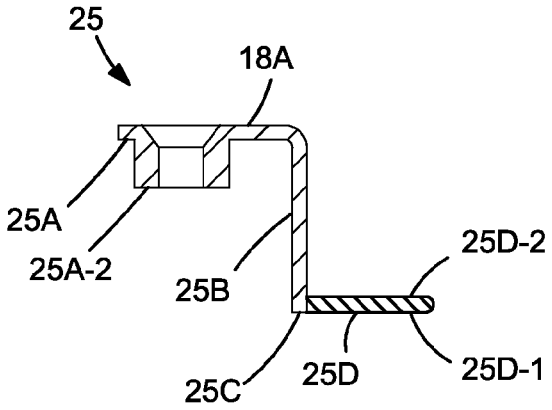
FIG. 5A is an enlarged partial cross-sectional view showing a first modification of the precision mounting insert of FIG. 5.
Figure 5B:
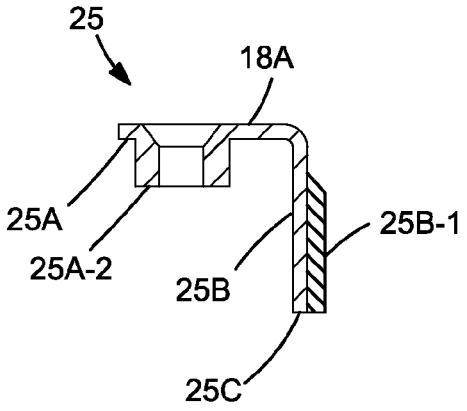
FIG. 5B is an enlarged partial cross-sectional view showing a second modification of the precision mounting insert of FIG. 5.

As can be further seen in FIGS. 5A and 5B, the first portion 25A of the precision mounting insert 25 may be formed on its underside with counter-bored mounting posts 25A-2 for securing the insert to the manhole frame 16 using the fasteners 25A-1. Various additional control surfaces may also be defined on the precision mounting insert 25 to perform further control functions. As will now be described, these control surfaces are recessed within the manhole 14 and provide additional security due the ability to relocate various security components of the manhole security cover 2. In particular, switches and/or sensors can be moved inward and down within manhole frame cavity, thereby making access with slim jim type devices more difficult, if not impossible.

For example, FIG. 5A shows that the mounting insert 25 may be formed with a third portion 25D that extends generally horizontally and is formed with respective lower and upper horizontal control surfaces 25D-1 and 25D-2. The lower horizontal control surface 25D-1 can be used to provide additional support for precision engagement of the latches 22 and 24 as they slide between their latching and unlatching positions. The upper horizontal control surface 25D-2 can be used to support precision engagement with vertically oriented tamper sensors. One example would be the switch units 40 that are described in more detail below. These switch units have cam levers 44 that could be positioned to engage the horizontal control surface 25D-2 when the manhole security cover 2 is lowered onto the manhole frame 16.

FIG. 5B shows that the second portion 25B of the mounting insert 25 may be formed with a vertical control surface 25B-1. The vertical control surface 25B-1 can be used to support precision engagement with horizontally oriented tamper sensor switches or sensors. The top edge of the vertical control surface 25B-1 may have an angled ramp configuration. This angled control surface may be used to help activate a plunger or roller style switch or lever having a horizontal plunger or roller. The upper ramp would gradually depress the plunger or roller as the manhole security cover 2 is lowered onto the manhole frame 16 and the main portion of the vertical control surface 25B-1 would retain the plunger or roller in the depressed position until the manhole security cover is lifted. The bottom edge of the vertical control surface 25B-1 will provide an extension of the latching control surface 25C to assist in retaining the latches 22 and 24.

Returning now to FIGS. 1-3, the latches 22 and 24 are each carried by respective latch assemblies 28 and 30 that are mounted to the second surface 8 of the manhole cover body 4. Each latch assembly 28 and 30 includes a fixed front tower (28A and 30A respectively) and a fixed rear tower (28B/30B respectively), that slidably carry an associated one of the latches 22 and 24. Each latch assembly 28 and 30 further includes a compression spring (28C and 30C respectively) or other biasing element to bias an associated one of the latches 22 and 24 to its extended latching position. The latch drive unit 26 is configured as a rotatable assembly that includes a first drive arm 26A and a second drive arm 26B extending from a common drive hub 26C. The first drive arm 26A is operatively connected to the latch assembly 28 by way of a pin 32 (see FIGS. 2 and 3) that engages the latch 22. This connection is further shown in FIG. 4. The second drive arm 26B is operatively connected to the latch assembly 30 by way of a connecting member that may be implemented as an activation cable 34 that attaches to the inboard end of the latch 24.

Figure 6:
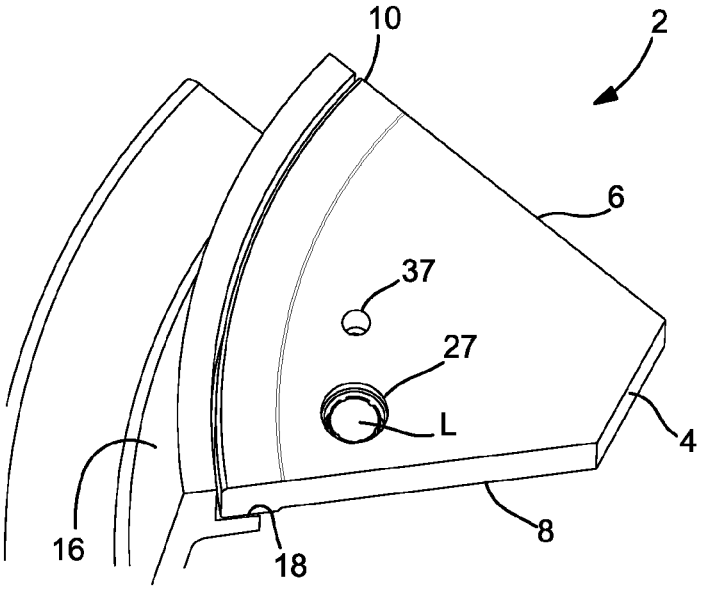
FIG. 6 is a partial perspective view showing an upper side of the manhole security cover of FIG. 1.

As can be seen in FIG. 6, the drive hub 26C extends through an aperture 27 in the manhole cover body 4 to the first side 6 thereof. At this location, which is accessible from outside the manhole 14, the drive hub 26C is provided with a security lock "L" that is configured for engagement by a security key (not shown). It should be noted that although FIG. 6 shows the first side 6 of the manhole cover body 4 being perfectly smooth, this is for ease of illustration only. As shown in FIGS. 4 and 5, the first side would typically have an anti-slip pattern 35, such as a pattern of ridges and grooves, dimples, etc. The term "generally planar" as previously used to describe the first side 6 is intended to encompass constructions that includes such patterns.

FIG. 2 illustrates the latch mechanism 20 in its fully latched state. A shadow line representation of the latch drive unit 26 after it has been rotated to effect unlatching of the latch mechanism 20 is also shown in FIG. 2. When the drive arm 26B is in this rotated (unlatched) position, it engages a keeper member 36 mounted on the second side 8 of the manhole cover body 4. The keeper member 36 has a ramp 36A that deflects the drive arm 26B as it rotates over the keeper member. When the drive arm 26B reaches the end of the ramp 36A at its fully rotated position, it will spring back to its undeflected position and become trapped by the keeper member 36. The keeper member 36 thus retains the latch mechanism 20 in its unlatched position while the manhole security cover 2 is removed from the manhole frame 16 in order to access the manhole 14. As shown in FIG. 6, a small bore 37 is formed in the manhole cover body 4 so the end of the drive arm 26B can be engaged by a tool (not shown) and deflected out of engagement with the keeper member 36 to relatch the manhole security cover 2 after it has been placed back onto the manhole frame 16.

It will be appreciated that the illustrated latch mechanism 20 represents just one possible design that may be used for mechanically securing the manhole security cover 2 to the manhole frame 12. Other latch mechanisms may also be used, including but not limited to the latch mechanism of the self-locking manhole cover shown and described in commonly-owned U.S. patent application Ser. No. 12/900,227 (the "'227 application"), entitled "Corrosion-Resistant Self-Locking Manhole Cover." The entire contents of the '227 application are hereby incorporated herein by this reference. Other latch designs would also be possible, including designs that use cam locks or other rotatable locking devices, or even bolts or screws, to fasten the manhole cover body 4 to the manhole frame 16. In a further embodiment, it would be possible, albeit not necessarily desirable, to dispense with latching altogether. In this instance, reliance could be placed solely on the manhole security cover's electronic security system.

As will now be described, the above-mentioned electronic security system may include one or more manhole cover tamper sensors that are responsive to a predetermined movement of the manhole cover body 4, such as a threshold displacement from its seated position on the manhole frame 16. In the embodiment of FIGS. 1-3, there are three tamper sensors implemented as identical tamper sensor switch units 40. The tamper sensor switch units 40 are mounted to the second side 8 of the manhole cover body 8 at locations that are approximately 120 degrees apart. This spaces the tamper sensor switch units 40 equidistantly from each other in order to detect partial lifting of the manhole cover body 4. Other spacing arrangements could also be used. Depending on application needs, additional tamper sensor switch units could be added. Alternatively, the number of tamper sensor switch units could be reduced.

Each tamper sensor switch unit 40 has a radially oriented main switch housing 42 made from a rigid material, such as a polycarbonate-ABS blend or alternatively a suitable metal, that can withstand contact with the ground or other surface when the manhole security cover 2 is removed from the manhole 14. Despite their durable construction, the main switch housings 42 are located radially inboard of the peripheral edge portion 10 of the manhole cover body 4 to minimize the possibility of damage. Extending from the radial outboard end of each switch housing 42 is a movable switch actuator 44 that is located at the peripheral edge portion 10 of the manhole cover body 4. The switch actuators 44 are positioned to engage the manhole cover support surface 18 of FIG. 4, or the alternate manhole cover support surface 18A of FIG. 5, when the manhole cover body 4 is in a seated position on the manhole frame 16. As can be seen in FIG. 3, each of the switch actuators 44 is designed so that its manhole frame engaging surface (the surface facing downwardly in FIG. 3) is substantially flush with the adjacent manhole frame-engaging surface on the second side 8 of the manhole cover body 4. As previously described, this frame-engaging surface will be at the peripheral edge portion 10 of the manhole cover body 4, and may include the protective gasket 10A. Advantageously, the rigid construction of the switch housings 42 helps ensure that accurate positioning of the switch actuators 44 will be maintained.

Figure 7A:
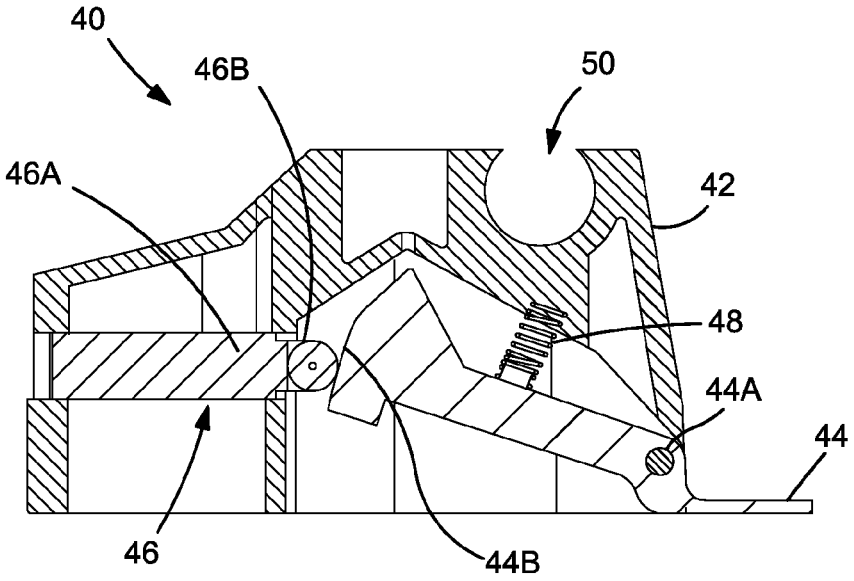
FIG. 7A is a cross-sectional centerline view showing a manhole cover tamper sensor switch in a first switching position.
Figure 7B:
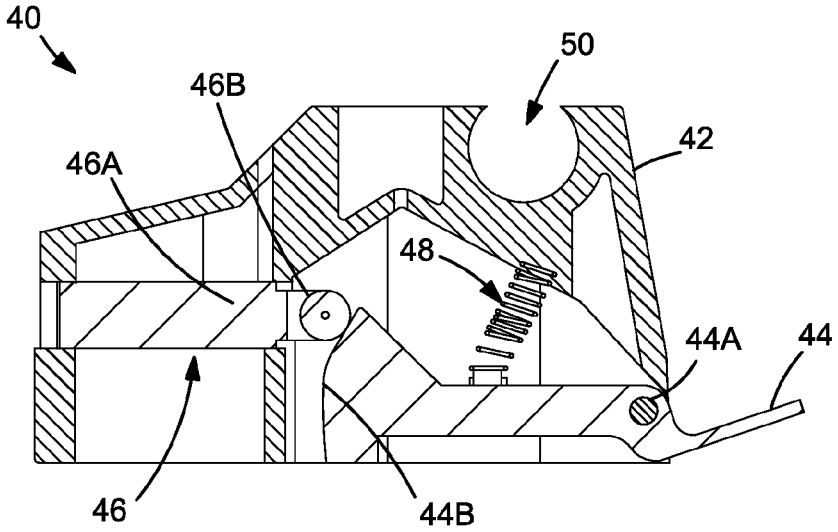
FIG. 7B is a cross-sectional centerline view showing a manhole cover tamper sensor switch in a second switching position.

Further details of the tamper sensor switch units 40 may be understood with additional reference to FIGS. 7A and 7B. Within each tamper sensor switch unit 40, the switch actuator 44 is pivotally mounted to the switch housing 42 to act as a pivotable cam lever that can pivot about a pivot point 44A between a first position shown in FIG. 7A and a second position shown in FIG. 7B. The inboard end of the switch actuator 44 has a cam surface 44B. The switch housing 42 further includes an environmentally resistant switch 46. In the illustrated embodiment, the switch 46 is implemented as a plunger-style, industry-rated limit switch that includes a spring-loaded switch plunger 46A. As used herein, any reference to an item being "industry-rated" means that the item has been rated by an applicable standards body, such as NEMA (National Electrical Manufacturers Association) in the case of the switch 46. Although not shown, the inboard end of the switch plunger 46A (toward the left side of FIGS. 7A and 7B) is operable to open and close the switch's electrical contacts as the switch plunger is actuated. The outboard end of the switch plunger 46A (toward the right side of FIGS. 7A and 7B) comprises a roller-type cam follower 46B that rides on the switch actuator cam surface 44B. Due to its spring loading, the switch plunger 46A is normally in the extended (home) position shown in FIG. 7B. FIG. 7A shows the switch plunger 46A in a retracted (actuated) position. Depending on whether the switch 46 has a normally-open or normally-closed design, the switch's extended position will either open or close its electrical contacts, and the switch's refracted position will produce the opposite effect. As described in more detail below, the tamper sensor switch units 40 of the illustrated embodiment use normally-open switches that are held closed to provide a normally-closed alarm circuit. Alternatively, it would also be possible to use normally-closed switches that are held open to provide a normally-open alarm circuit.

Motion is transferred to the switch plunger 46 via the cam-lever mechanism of the switch actuator 44. In FIG. 7A, the switch actuator 44 is in a first pivot position wherein the switch actuator cam surface 44B depresses the switch plunger 46A to its retracted position. This is an armed position of the switch actuator 44 that will result when the manhole cover body 4 is seated on the manhole frame 16 and the switch actuator 44 engages the manhole cover support surface 18 or 18A. In FIG. 7B, the switch actuator 44 is in a second pivot position wherein the switch actuator cam surface 44B allows the switch plunger 46A to return to its extended position. A compression spring 48 is provided in the switch housing 42 to urge the switch actuator 44 to its second pivot position when the switch actuator is no longer in contact with the manhole cover support surface 18 or 18A. This is the home position of the switch actuator 44. The tamper sensor switch units 40 are designed so that the switch actuator 44 will actuate the switch plunger 46 in response to a predetermined movement of the manhole cover body 4. For example, the switch plunger 46 could be actuated when the manhole cover body 4 is raised from the manhole cover support surface 18 or 18A by one-half of its thickness. Other predetermined movements could also be defined. As described in more detail below, this will generate a manhole cover tamper alert signal.

It will be observed from FIGS. 7A and 7B that the switch housing 42 further includes a channel 50 made from a suitable rigid material. As shown in FIGS. 1-3, the channel 50 allows the switch housing 42 to support an optional skid member 52 that protects the components mounted on the second side 8 of the manhole cover body 4 from damage due to the impact with the ground or other surface as a result of dropping, dragging, etc. If desired, additional skid member support towers 54, each having a skid member support channel, may be provided to help support the skid member 52 and prevent it from deflecting. Alternatively, the skid member support towers 54 could be used exclusively, such that the switch housings 42 do not participate in supporting the skid member 52. Although the skid member 52 is configured as a ring in FIGS. 1-3, it could also have other shapes. Moreover, instead of a single large skid member 52, several smaller skid members (of any desired shape) could be used.

It will be appreciated that the cam-lever style switch actuator 44 of FIGS. 7A and 7B is only one type of switch actuator that may be used in the manhole security cover 2. Other switch actuator designs would include actuators comprising plungers, pins or rollers, to name but a few. It will also be appreciated that the plunger-style switch 46 of FIGS. 7A and 7B is only one type of switch that may be used in the manhole security cover 2. In the illustrated embodiment, the switch plunger 46A provides a cam-following trigger that is actuated by the cam surface 44B of the switch actuator 44. Other types of switches would include switches with lever style triggers, roller style triggers, toggle style triggers, etc. The tamper sensor switch units 40 could also be implemented with switches that directly engage the manhole cover support surface 18 or 18A without using a separate switch actuator. In this type of switch, the switch actuator could be an integral part of the switch instead of a separate mechanism.

As can be seen in FIGS. 1 and 2, the tamper sensor switch units 40 are each electrically connected via an insulated twin-conductor switch unit wire 56 to a main electronics housing 58. The switch unit wires 56 may be covered with a stainless steel (SST) flexible shielding (e.g., BX type cable). This provides resistance to damage or abrasion, and provides added security. The housing 58 can be mounted on the second side 8 of the manhole cover body 4. As used herein, any reference to "mounting" an item "on" the second side 8 of the manhole cover body 4 includes mounting the item directly to the second side as well as mounting the item to another component on that side of the manhole cover body, such as the skid member 52. The latter configuration may be advantageous in some cases by reducing the number of mounting holes in the manhole cover body 4, which can reduce the overall strength of the manhole security cover 2.

Figure 8:
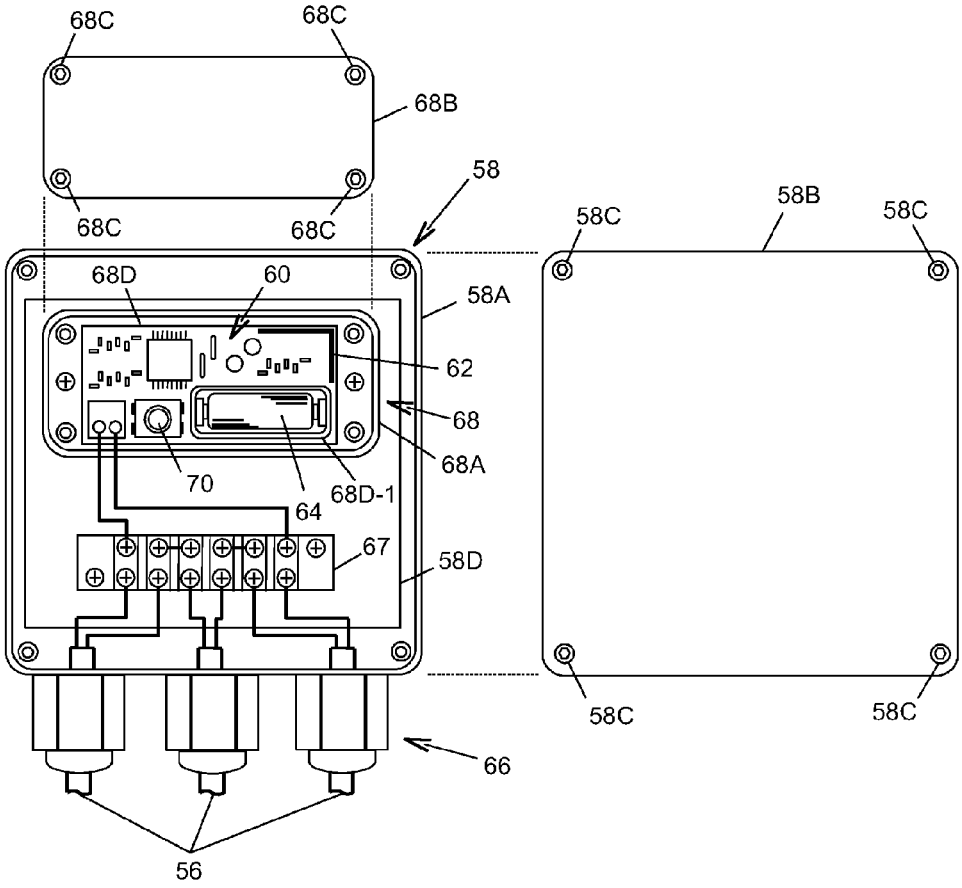
FIG. 8 is a plan view showing a first arrangement of wireless security components that may be used with the manhole security cover of FIG. 1.

As additionally shown in FIG. 8, the main housing 58 contains electronic components that provide a security response when the tamper sensor switch units 40 detect manhole cover tampering. Most notably, the main housing 58 contains a transmitter 60, an antenna 62, a battery power source 64, connection ports 66 that receive the switch unit wires 56 from the tamper sensor switch units 40, and a connection terminal block 67 where the switch unit wires 56 are terminated. The transmitter 60 is operatively connected to the tamper sensor switch units 40 via the connection terminal block 67. It is configured (e.g., using programmed or hard-wired operational logic) to generate a radio frequency manhole cover tamper signal when the tamper sensor switch units 40 detect a predetermined movement of the manhole security cover body 4. The antenna 62 is operatively coupled to the transmitter 60 to radiate radio frequency energy through the manhole cover body 4.

A wireless receiver (not shown) may be situated at a location outside of the manhole 14 to receive the manhole cover tamper signal. This receiver may be configured as part of a dedicated manhole security system (i.e., for a city or municipality) that implements a manhole security network for monitoring a plurality of manhole security covers. In order to support such operations, each transmitter 60 may be assigned a unique ID number that identifies the transmitter when it makes a transmission, thereby allowing the transmitter and its location to be determined. When the receiver detects the manhole cover tamper signal, the manhole security system may implement an appropriate security response. The security response may include notifying designated personnel of a potential manhole cover security breach, such as by sending email and/or text message notifications, or otherwise. The receiver could also be added to an existing security system that is not necessarily dedicated to manhole security (i.e., an industrial premises security system). Adding the receiver to an existing security system would integrate the manhole security cover 2 into such a system. Depending on the underlying hardware and interface capabilities of the security system's computer(s), the system computer(s) could run an events management software application that controls manhole cover security operations.

In the illustrated embodiment of FIG. 8, the tamper sensor switch units 40 are wired in series to the transmitter 60. As previously described, the switches 46 are designed to be normally open but are held closed by the switch actuators 44 when the manhole cover body 4 is installed on the manhole frame 16. This provides a normally-closed alarm circuit. If any of the switches 46 are tripped, the alarm circuit will open and the transmitter 60 will generate its manhole cover tamper signal. In an alternate alarm configuration, the tamper sensor switch units 40 could be wired in parallel to the transmitter 60. The tamper sensor switch units 40 could then have a normally closed design but would be held open by the switch actuators 44 when the manhole cover body 4 is installed on the manhole frame 16. This will provide a normally-open alarm circuit. If any of the switches 46 are tripped, the alarm circuit will close and the transmitter 60 will generate its manhole cover tamper signal. Advantageously, in either a series or parallel wiring configuration, the tamper sensor switch units 40 will consume little or no power, thereby maintaining the life of the battery 64. This may obviate the need for a secondary battery source, although one or more backup batteries could be added if desired.

The main housing 58 is an industry-rated enclosure made from rigid plastic or other suitable material and designed for protection from environmental exposure. It includes a base 58A and a removable cover 58B that may be joined together with screws or other fasteners 58C. Although not shown, a gasket seal may be disposed between the base 58A and the cover 58B to help provide the desired level of environmental protection. The main housing can be removably mounted on the second side 8 of the manhole cover body by attaching it to a desired support structure (e.g., the second side itself, the skid member 52, etc.) with appropriate fasteners (not shown). The connection ports 66 may be provided by industry-rated sealing glands or compression fittings to provide sealed wire entry points into the main housing 58. Shrink-wrap tubing may be placed on the outside of the connection ports 66 and a short section of the switch unit wires 56 where they enter the connection ports. The inside of the connection ports 66 can be potted with epoxy to provide further sealing and also to prevent wire pullout and provide torque retention for all gland nuts.

If desired, the transmitter 60, the antenna 62 and the battery 64 may be enclosed in a separate transmitter housing 68. The transmitter housing 68 may be provided by an industry-rated enclosure made from rigid plastic or other suitable material, and may be optionally designed for protection from environmental exposure. The transmitter housing 68 is removably attached to a main component board 58D disposed within the main housing 58. The main component board 58D also mounts the connection terminal block 67. Placing the transmitter 60, the antenna 62 and the battery 64 in a discrete transmitter housing 68 allows these components to be replaced or upgraded as a unit by simply removing the transmitter housing from the main housing 58 and installing a different unit. The transmitter housing 68 includes a base 68A and a removable cover 68B that may be snapped together or possibly joined with screws or other fasteners 68C. Within the transmitter housing 68 is a circuit board 68D that mounts the components of the transmitter 60. The circuit board 68D also carries the antenna 62 as a printed trace whose geometry is configured for the operational frequency and signal characteristics of the transmitter 60. Other antenna mounting options are described in more detail below. The circuit board 68D further includes a battery holder 68D-1 that removably mounts the battery 64.

Figure 9:
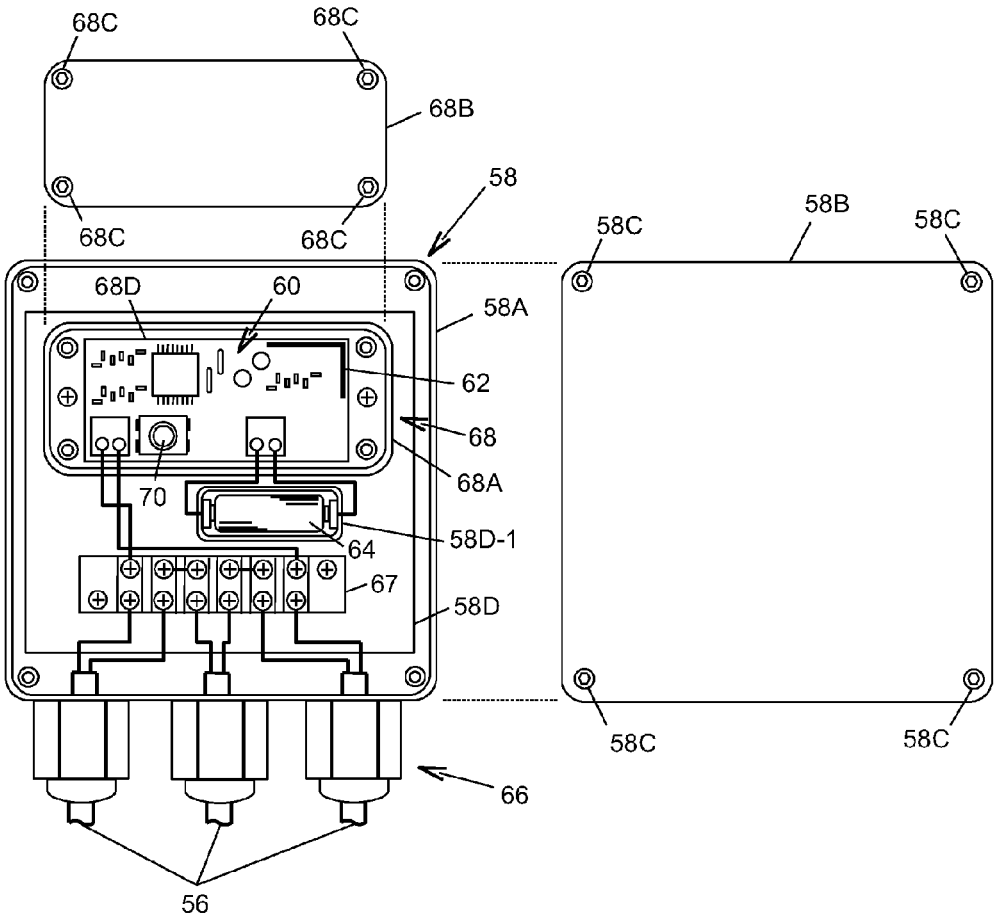
FIG. 9 is a plan view showing a second arrangement of wireless security components that may be used with the manhole security cover of FIG. 1.

In an alternate arrangement, the battery 64 could be moved from the transmitter housing 68 to the main housing 58, such that the main housing would additionally function as a battery housing. This configuration is shown in FIG. 9. The main housing 58 now includes a battery holder 58D-1 on the main component board 58D. Additional wiring is added between the battery holder 58D-1 and the transmitter housing's circuit board 68D-1 to provide the required connections for powering the transmitter 60. The transmitter housing 68 is again removably mounted to the main component board 58C. Because the battery is now in the main housing 58, the battery may be replaced without entering the transmitter housing. Moreover, the transmitter housing 68 can be removed from the main housing 58 in order to replace the transmitter 60 and the antenna 62 without disturbing the battery 64.

Figure 10:
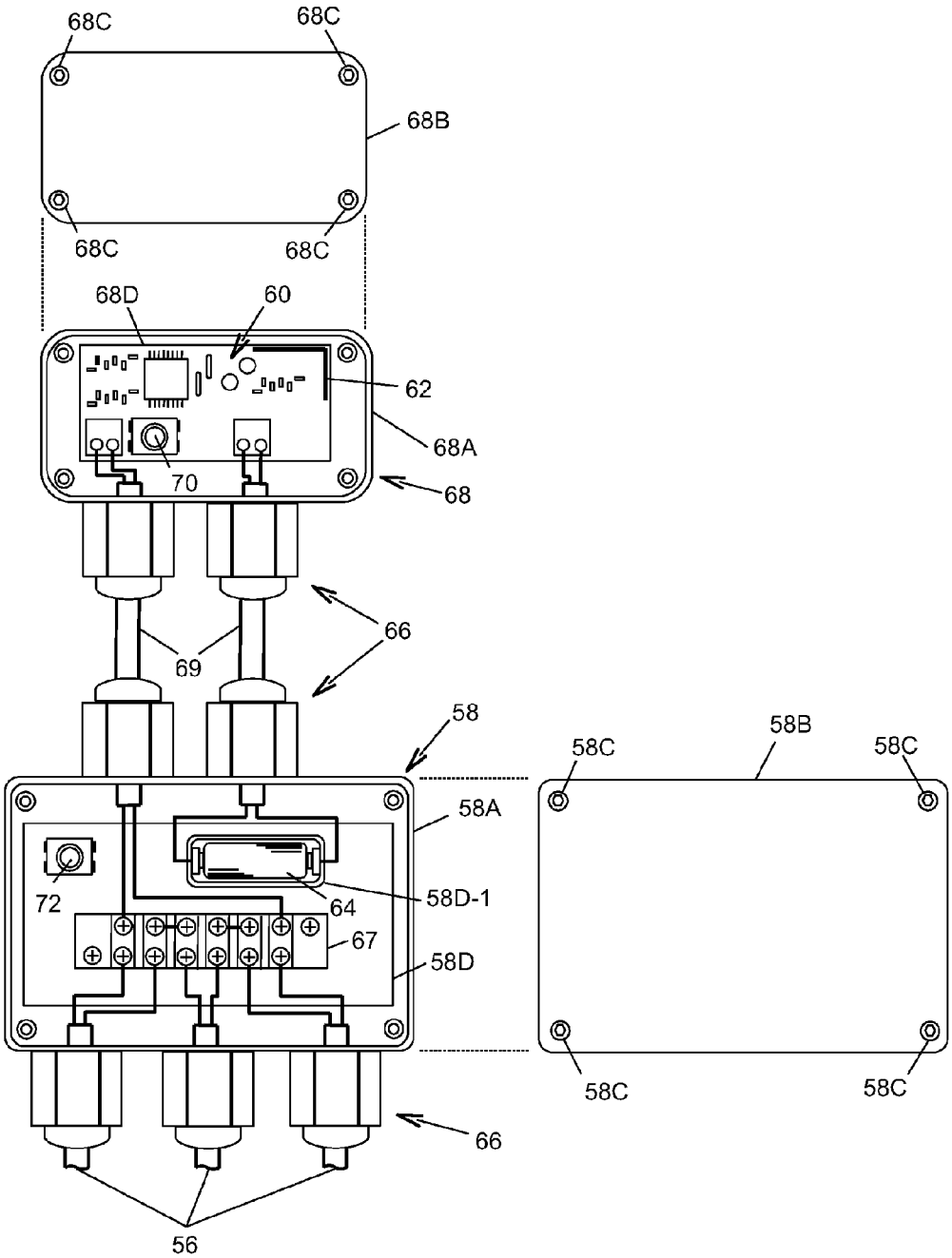
FIG. 10 is a plan view showing a third arrangement of wireless security components that may be used with the manhole security cover of FIG. 1.

In a further alternate arrangement, the battery 64 could be moved from the transmitter housing 68 to the main housing 58 and the transmitter housing 68 could be removed from the main housing and removably mounted at a separate location on the second side 8 of the manhole cover body 4. One possible arrangement is shown in FIG. 10. In this configuration, the removable transmitter housing cover 68B is preferably secured to the transmitter housing base 68A with screws or other fasteners 68C. Moreover, although not shown, a gasket seal may be disposed between the base 68A and the cover 68B to help provide the desired level of environmental protection since the transmitter housing 68 is no longer protected by the main housing 58. As a further modification, two additional twin-conductor wires 69 are added between the main housing 58 containing the battery 64 (now primarily a battery housing) and the transmitter housing 68. One of the wires 69 connects the transmitter 60 to the connection terminal block 67 while the other provides the necessary power connections to the battery 64. Note that the connection terminal block 67 and the connection ports 66 for the switch unit wires 56 are still present at the main housing 58. It would also be possible, and perhaps more desirable, to relocate the connection terminal block 67 and the connections 66 to the transmitter housing 68 and connect the switch unit wires 56 to that housing. An example of such an arrangement is shown in a subsequent embodiment that features an additional transmitter for sensing actuation of the latch mechanism 20 (see FIGS. 14-15).

In each of the embodiments of FIGS. 8-10, a commercially available programmable transmitter & receiver may be used to provide the transmitter 60 and the antenna 62. One example device would be a universal transmitter and receiver from Inovonics of Louisville, Colo. The transmitter 60 and the antenna 62 may operate at any desired frequency, such as within a range of approximately 850-950 MHz. The transmitter 60 may transmit using any suitable transmission technology, such as digital spread spectrum in the case of an Inovonics universal transmitter and receiver. Other transmission formats commonly used for cellular, Wi-Fi, WPAN or other communications standards may also be used. For additional security, the transmitter 60 could be modified to transmit an encrypted RF signal. Alternatively, a secondary device (not shown) may be added to the transmitter 60 to provide signal encryption.

As mentioned above, the transmitter 60 may implement programmed or hardwired operational logic. One of the functions performed by this logic is to generate a manhole cover tamper signal whenever one of the tamper sensor switch units 40 changes state due to detecting a predetermined movement of the manhole cover body 4. Depending on application requirements, the transmitter 60 may also implement logic that provides additional security features. For example, the transmitter 60 could check in with a remote security system (described above) by generating a periodic heartbeat signal at a prescribed time interval (supervision window). Failure of the security system to receive the heartbeat signal (whether due to a security breach, a transmitter malfunction, signal blocking or interference, etc.) would result in a response action being taken, such as generating an alarm indicating that the manhole security cover 2 may have a security problem requiring investigation. The transmitter 60 will typically operate at a standard voltage, such as 3 volts D.C. The transmitter 60 may be additionally programmed so that if the voltage received from the battery 64 drops to a specified level below the standard value, the transmitter will transmit a low battery signal indicating that the battery must be changed. For example, assuming a standard voltage of 3 volts, the transmitter 60 could generate the low battery signal if the battery voltage drops to 2.4 to 2.6 volts. The low battery signal could be the same as or different than the manhole cover tamper signal generated when the tamper sensor switch units 40 are triggered.

As previously described, the antenna 62 can be printed on the transmitter circuit board 68D to facilitate ease of removal for repair or replacement. Alternatively, the antenna 62 could be hard-wired or otherwise mounted on the circuit board 68D. It could also be mounted on the transmitter housing 68 or perhaps the main housing 58. As a further alternative, the antenna 62 could be embedded or otherwise integrated into one or more composite material layers of the manhole cover body 4. The antenna 62 could also be mounted to the second side 8 of the manhole cover body, outside of both the main housing 58 and the transmitter housing 68.

The manhole security cover 2 may be engineered to address the concern of a person coming up from within the manhole 14 in order to circumvent the cover and its security components. For example, the latch mechanism 20 may be designed to prevent the manhole security cover 2 from being easily opened from within the manhole 14. This could be done by ensuring that the compression springs 28C and 30C of each latch assembly 28 and 30 have a large spring force so that it is difficult to operate the spring-loaded latches 22 and 24 without tools.

As a further security feature, the tamper sensor switch units 40 may be wired so that any attempt to cut or otherwise disrupt the switch unit wires 56 will generate a sensor disconnection indicating signal (which may be the same as or different than the manhole cover tamper signal generated when the tamper sensor switch units 40 are triggered). This feature may be facilitated by wiring the switch units 40 in series with the transmitter 60 in a normally closed alarm circuit. Any action that opens the alarm circuit, whether due to a switch unit 40 being actuated or a wire 56 being cut, would trigger a security response.

In order to prevent alarm circumvention by jumpering the tamper sensor switch units 40, the tamper sensor switch units may be designed to have a defined electrical resistance (such as by embedding a resistor therein). The transmitter 60 may then be configured generate the above-mentioned sensor disconnection indicating signal if it detects a change in resistance in the tamper sensor switch units 40 due to a jumpering attempt. Again, this sensor disconnection indicating signal may be the same as or different than the manhole cover tamper signal generated when the tamper sensor switch units 40 are triggered.

Tamper detection may also be provided on one or both of the main housing 58 and the transmitter housing 68. For example, FIGS. 8 and 9 illustrate the use of a transmitter housing tamper sensor implemented as a plunger style switch 70. FIG. 10 also shows the transmitter housing tamper sensor switch 70 and further illustrates a main housing tamper sensor that may also be implemented as a plunger style switch 72. Because the main housing 58 in FIG. 10 is also a battery housing, the tamper sensor switch 72 may additionally be thought of as a battery housing tamper sensor. The tamper sensor switch 70 is mounted on the transmitter circuit board 68D. The tramper sensor switch 72 is mounted on the main component board 58D.

The tamper sensor switch 70 will be engaged and depressed when the transmitter housing cover 68B is mounted on the transmitter housing base 68A. Removal of the transmitter housing cover 68B will activate the tamper sensor switch 70 and the transmitter 60 will generate a transmitter housing tamper signal (which may be the same as or different than the manhole cover tamper signal generated when the tamper sensor switch units 40 are triggered). The tamper sensor switch 72 will be engaged and depressed when the main housing cover 58B is mounted on the main housing base 58A. Removal of the main housing cover 58B will activate the tamper sensor switch 72 and the transmitter 60 will generate a main housing tamper signal (which may be the same as or different than the manhole cover tamper signal generated when the tamper sensor switch units 40 are triggered). This signal may also be referred to as a battery housing tamper signal insofar as main housing 58 in this embodiment serves as a battery housing. If desired, the tamper sensor switches 70 and 72 may each include an upwardly-extending coil spring to ensure active engagement between the switch plunger and the associated housing cover it engages.

Thus far, the tamper sensing functionality of the manhole security cover 2 has been described from the standpoint of an example embodiment in which tamper sensor switch units 40 are used to sense movement of the manhole cover body 4. Similarly, tamper sensor switches 70 and 72 are respectively used to detect tampering with the transmitter housing 68 and the main housing 58. It will be appreciated that many other types of manhole cover tamper sensors could be used in lieu of the illustrated tamper sensor switches, or could be used in addition thereto. These include, but are not limited to, other varieties of electromechanical switches, as well as various proximity sensors, tilt sensors, position sensors, inertial sensors, vibration sensors and infrared sensors, to name but a few.

For example, one or more proximity sensors could be used in lieu of the tamper sensor switch units 40 to sense the location of a metal surface such as the manhole cover frame 16, and would cause an alarm to be generated if this location or distance is changed.

In another embodiment, one or more tilt sensors could be used in lieu of the tamper sensor switch units 40 to generate an alarm if a "home" angle of the manhole cover body 4 is changed within a given time frame.

In a further embodiment, one or more position sensors could be used in lieu of the tamper sensor switch units 40 to generate an alarm if the manhole cover body is moved from a "home" position within a give time frame.

In a still further embodiment, one or more inertial sensors could be used in lieu of the tamper sensor switch units 40 to sense if the manhole cover is accelerated up and down or from side to side.

In a still further embodiment, one or more vibration sensors could be used in lieu of the tamper sensor switch units 40 to generate an alarm if an increased amount of vibration (above and beyond vibrations generated by normal overhead traffic) is sensed (impact, etc.).

The tilt sensors, position sensors, inertial sensors and vibration sensors mentioned above may be implemented using a variety of devices, such as accelerometers, gyroscopes, piezoelectric sensors, etc., and may be constructed using a variety of technologies, including but not limited to MEMS (MicroElectroMechanical Systems) technology. Such sensors may be used alone or in combination, and may include single-function sensors and sensors that perform two or more sensing functions. The sensors may include appropriate circuitry (or perhaps mechanical control elements) to adjust their sensitivity and set their detection thresholds. This may be necessary so that the sensors do not respond to ambient "noise" due to normal forces and movements experienced by the manhole security cover 2 while it is in service. For example, a manhole cover used for a roadway application will typically experience deflections and vibrations due to the weight of overhead vehicles, impacts and other traffic-related conditions. If the sensors themselves do not have adjustable sensitivity and threshold control features, such functionality could be separately added to the manhole security cover 2, such as by placing sensor control circuitry in the main housing 58, in the transmitter housing 68, as part the transmitter 60 itself, or by any other suitable means.

In a still further embodiment, one or more infrared sensors could be used in lieu of the tamper sensor switch units 40 to generate an alarm if an infrared light beam is broken or the beam receiver is not hit for some other reason.

Environmental sensors for sensing temperature, humidity, underground concussions (e.g., pressure waves due to explosions), carbon monoxide levels and other conditions could also be added.

Figure 11:
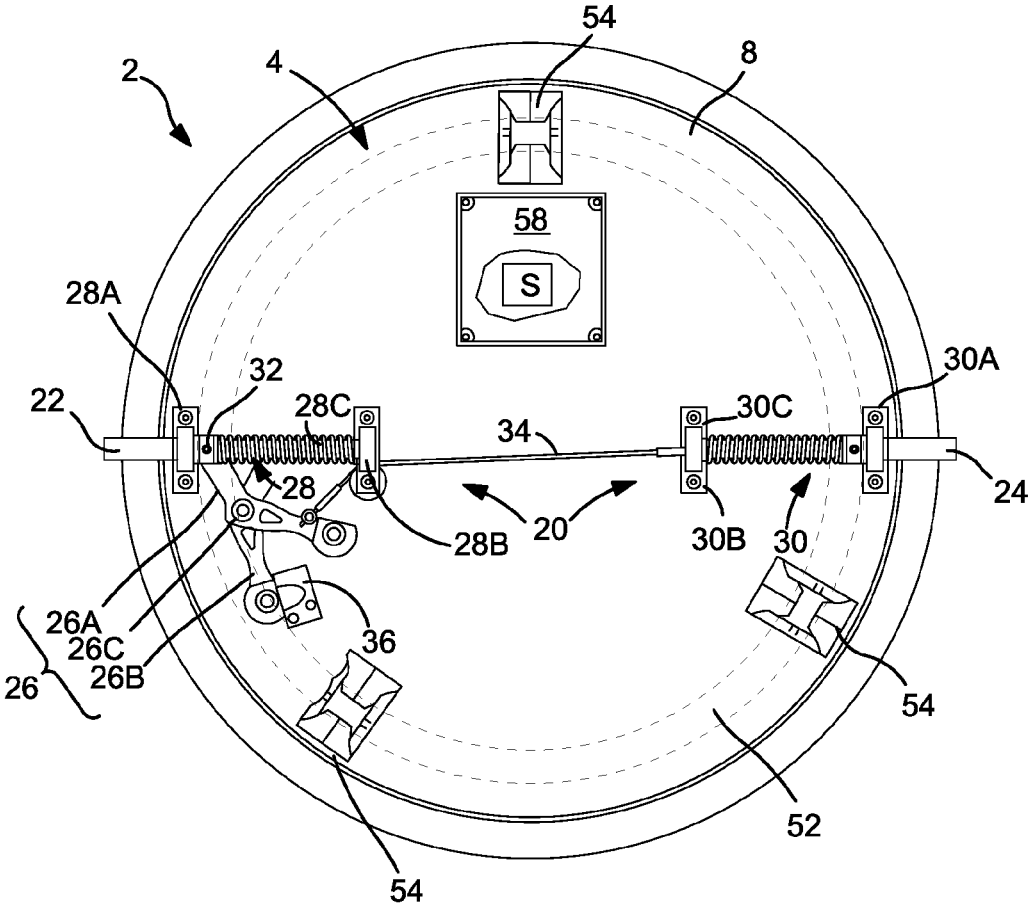
FIG. 11 is a plan view showing a modification of the manhole security cover of FIG. 1 that uses tamper sensors mounted in a main component housing.

FIG. 11 shows a modification of the manhole security cover 2 in which the tamper sensor switch units 40 are replaced by tamper sensors that use one or more of the foregoing sensor technologies. These one or more sensors are disposed within the main housing 58 and are designated by the letter "S." Advantageously, placing the sensor(s) in the main housing 58 would facilitate the retrofitting of existing manhole covers and would obviate the need for mounting separate tamper sensor switch units 40, their switch unit wires 56, and housing connection ports 66. It will be appreciated the sensor(s) could also be placed at any other desired location(s) on the manhole cover body, and do not necessarily need to be placed in the main housing 58, or in any other housing.

As an additional modification to the manhole security cover 2, a thin film sensor could be applied to all or part of the second side 8 of the manhole cover body 4, or could be embedded therein. Reference number 74 in FIG. 1 illustrates a small section of an example thin film sensor that may be embedded in the manhole cover body 4 (i.e., under the surface of the second side 8). The thin film sensor 74 could be implemented as a thin-film substrate that carries an electrical or fiber optic mesh that would be disrupted if a hole is drilled in the manhole cover body 4. Other thin film sensor technologies could also be used. Although not shown, the thin film sensor 74 could be wired to the transmitter 60 (or to a separate transmitter) so that a manhole cover integrity violation signal is generated if the manhole cover body 4 is penetrated, impacted, etc. This signal may be the same as or different than the manhole cover tamper signal generated when the tamper sensor switch units 40 are triggered.

Figure 12:
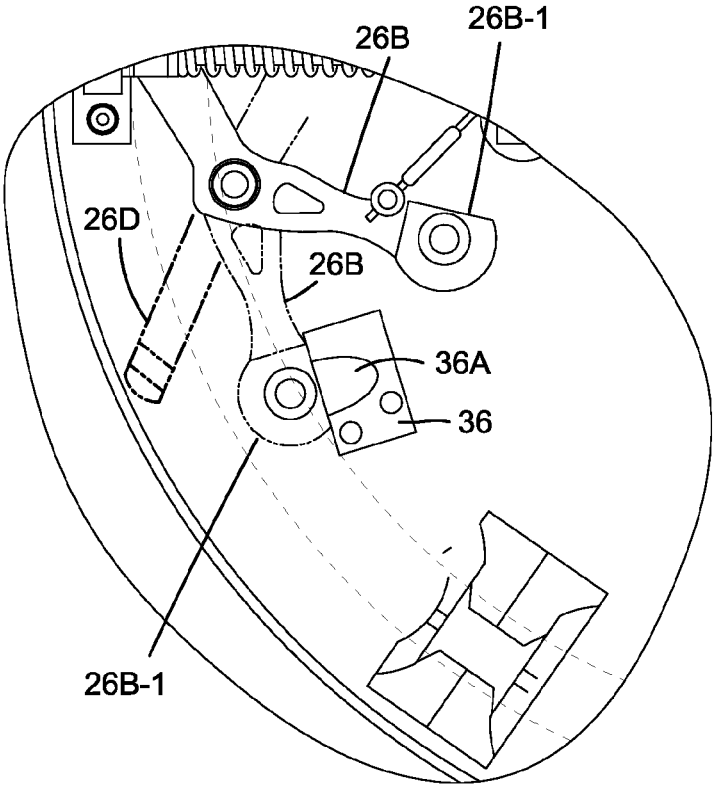
FIG. 12 is a fragmentary plan view showing another modification of the manhole security cover of FIG. 1 wherein a cover opening is protected against contaminant introduction.

As a further anti-penetration measure, the latch mechanism 20 could be modified so that the access hole 37 (see FIG. 6) for relatching the latch mechanism 20 is covered when the drive arm 26B rotates back to its latched position. This would prevent the unauthorized pouring of dangerous liquids or other contaminants into the manhole 14 through the access hole 37. As shown in FIG. 12, one way that this feature could be added is to provide a third drive arm 26D on the latch drive unit 26 that rotates along with the other two drive arms 26A and 26B as the drive hub 26C rotates. When the latch mechanism 22 is latched, the third drive arm 26D would be in the same position the drive arm 26B is in when it is unlatched, i.e., covering the access hole 37. If desired, the third drive arm 26D could be configured to engage the keeper member 36 so it cannot be deflected out of position by an object inserted through the access hole 37. When the latch mechanism 22 is unlatched, the third drive arm 26D would rotate away from the keeper member 36 while the drive arm 26B rotates to the position the third drive arm was just in, i.e., covering the access hole 37. This is the position shown in FIG. 12.

Figure 13:
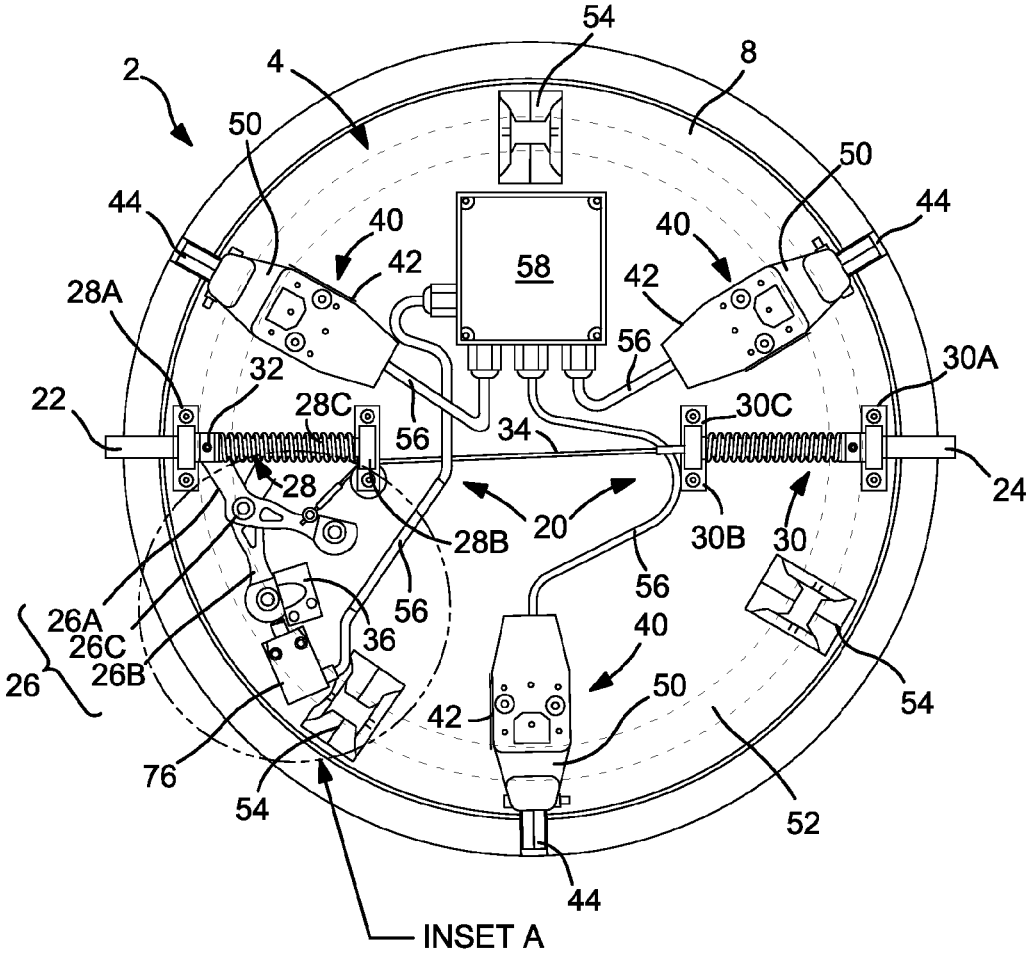
FIG. 13 is a plan view showing a further modification of the manhole security cover of FIG. 1 wherein a latch sensor is provided.

Turning now to FIG. 13, a further modification of the manhole security cover 2 is shown in which additional security is provided by monitoring the latching state of the latch mechanism 20. In this embodiment, the manhole security cover 2 includes a latch sensor that detects when the latch mechanism 20 is unlatched. The latch sensor may be used in conjunction with the manhole cover tamper sensor switches 40 to support a two-stage alert system and method wherein the receipt of an unlatching signal within a predetermined time period prior to receipt of the manhole cover tamper signal enables a determination of whether removal of the manhole security cover from the manhole opening is authorized. The latch sensor could also be used to notify when the manhole security cover 2 is latched, thereby allowing a remote security system to know that the manhole security cover has been properly secured following an authorized manhole access.

Figure 14:
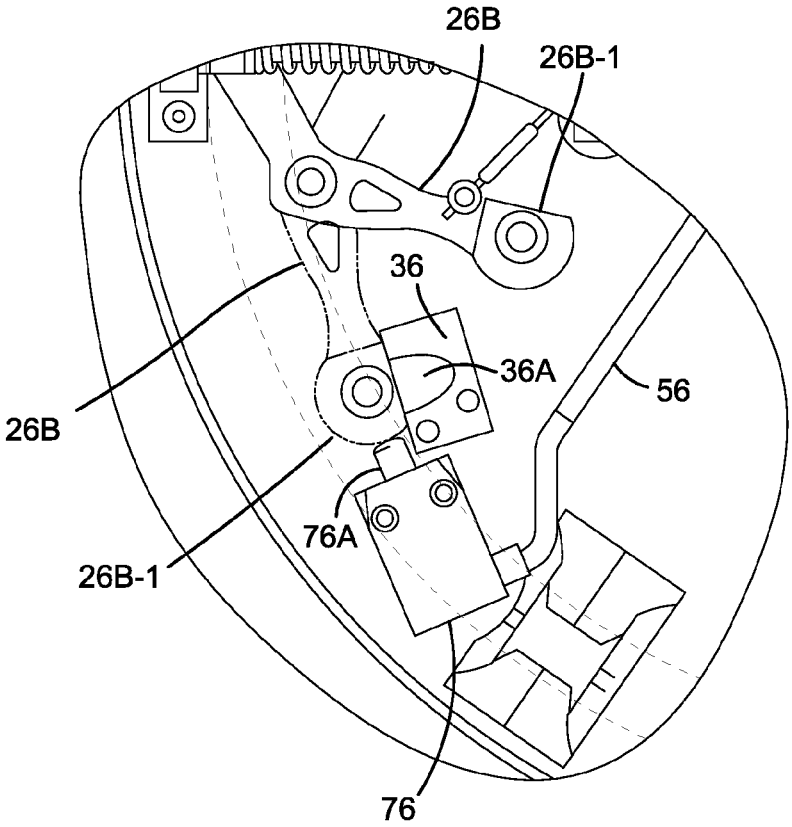
FIG. 14 is a fragmentary plan view showing inset "A" in FIG. 13.

As particularly shown in FIG. 14 (showing an enlargement of Inset "A" in FIG. 13), the latch sensor may be implemented as a plunger style switch 76 that is mounted on the second side 8 of the manhole cover body 4 at a location where it will be engaged by the drive arm 26B of the latch drive unit 26. The free end of the drive arm 26B may be formed with a cam surface 26B-1. This cam surface depresses a plunger 76A of the latch sensor switch 76 as the drive arm is rotated into locking engagement with the keeper member 36. It will be appreciated that other types of latch sensors could also be used, including other varieties of electromechanical switches, as well as various proximity sensors, position sensors, inertial sensors, vibration sensors and infrared sensors, to name but a few.

Figure 15:
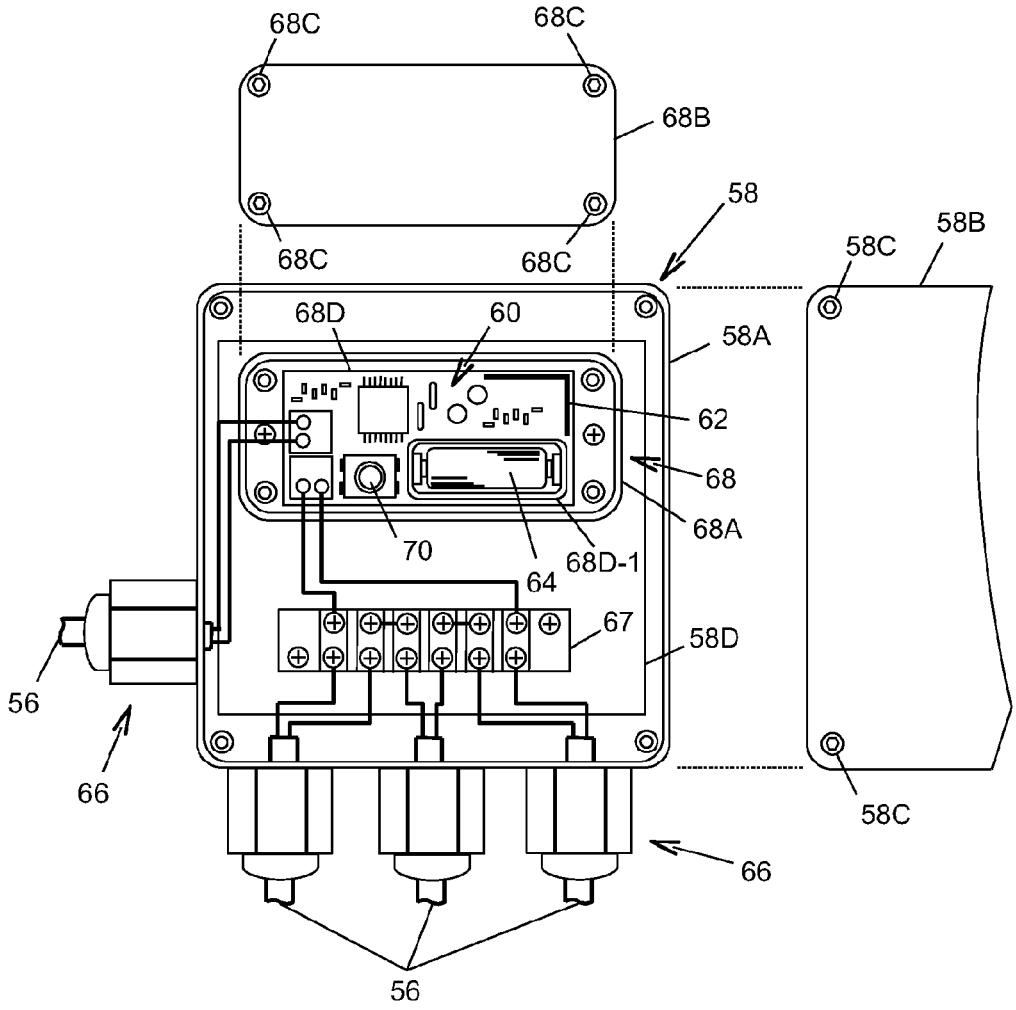
FIG. 15 is a plan view showing an arrangement of wireless security components that may be used with the modified manhole security cover of FIG. 14.

A twin-conductor latch sensor wire 56 may be used to electrically connect the latch sensor switch 76 to either the transmitter 60 or to a separate transmitter. The latch sensor wire 56 may be of the same construction as the switch unit wires 56 described above. FIG. 15 illustrates an embodiment wherein the latch sensor switch 76 is electrically connected to the transmitter 60 in the main housing 58. FIG. 15 is similar to the arrangement shown in FIG. 8 except that the main housing 58 has been modified by adding an extra connection port 66 to accommodate the new wire 56 from the latch sensor switch 76. Due to space limitations, FIG. 15 also illustrates only a portion of the main housing cover 58B. Although the latch sensor switch 76 could be wired in series with the tamper sensor switch units 40, doing so would not allow a manhole cover tamper event to be distinguished from a latch mechanism unlatching event. Thus, the twin-lead wire 56 from the latch sensor switch is shown being connected to a separate input of the transmitter 60. The transmitter 60 may be modified to include a separate channel for transmitting a manhole cover unlatching signal that is distinguishable from the manhole cover tamper signal. This separate channel could be implemented in various ways, such as by using a separate frequency, or by using a suitable form of signal multiplexing, or by using a digital encoding technique.

Figure 16:
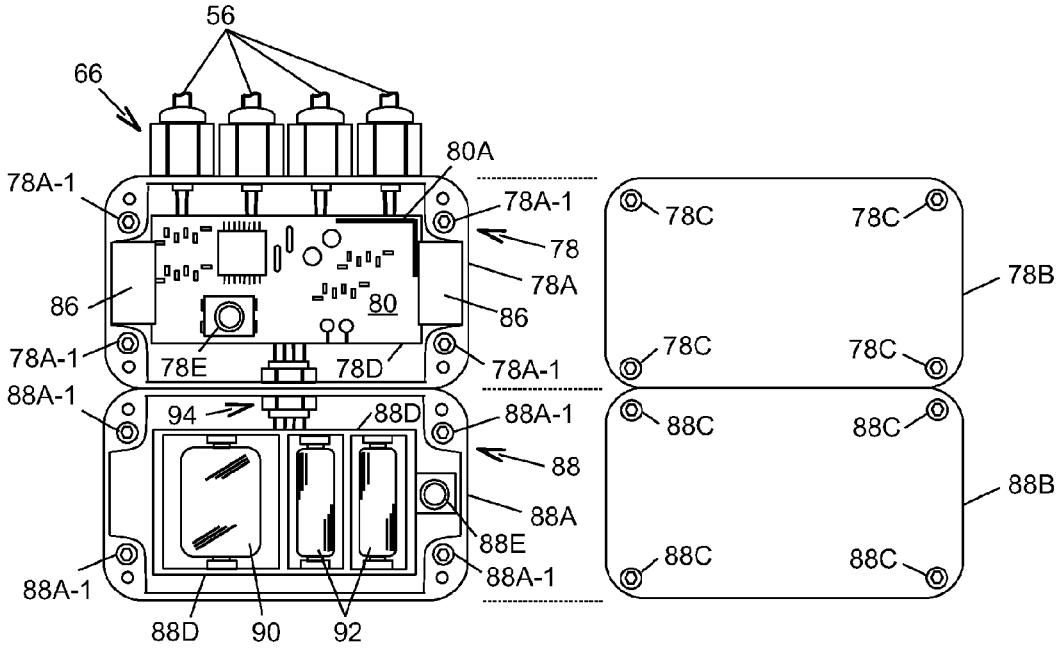
FIG. 16 is a plan view showing another arrangement of wireless security components that may be used with the modified manhole security cover of FIG. 14.
Figure 17:
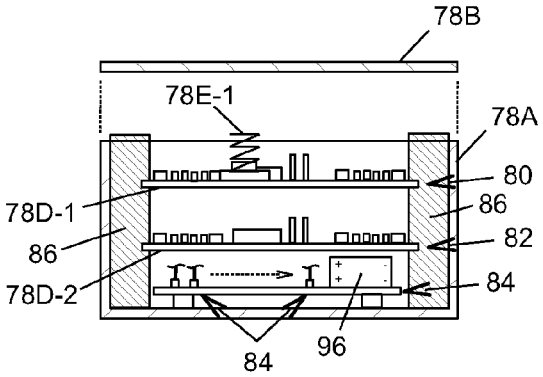
FIG. 17 is a cross-sectional centerline view showing a transmitter housing and its components as illustrated in FIG. 16.

FIGS. 16 and 17 illustrate an alternative approach wherein a separate transmitter is used to support latch sensing operations. FIGS. 16 and 17 also depict the use of a modified component arrangement that is somewhat different than the configurations shown in FIGS. 8-10 and 15. In particular, there is now a transmitter housing 78 that houses a stacked component array comprising a first transmitter 80, a second transmitter 82, and a connection block 84. Other component arrangements would also be possible, including arrangements wherein the connection block is on top, arrangements wherein the component stack is oriented edgewise in FIG. 14, and arrangements wherein there is no stacking at all, The connection block 84 includes plural connections 84A that are shown as being solder joints, but which could also be screw connections. The connections 84A are used for (1) connecting the first transmitter 80 to the tamper sensor switch units 40, (2) connecting the second transmitter 82 to the latch sensor switch 76, and (3) connecting both transmitters to a battery power source (described below). Hereinafter, the first transmitter 80 will be referred to as a tamper sensor transmitter and the second transmitter 82 will be referred to as a latch sensor transmitter.

The transmitter housing 78 includes a base 78A and a removable cover 78B that may be joined together with screws or other fasteners 78C. Although not shown, a gasket seal may be disposed between the base 78A and the cover 78B to help provide the desired level of environmental protection. The transmitter housing 78 can be removably mounted on the second side 8 of the manhole cover body using screws 78A-1 or other fasteners to attach it to the second side itself or to other structure on that side of the manhole cover body 4 (such as the skid member 52). Within the transmitter housing 78, a first circuit board 78D-1 mounts the components of the tamper sensor transmitter 80. These components include an antenna 80A that may be formed as a printed trace or otherwise mounted on the circuit board 78D-1 (or elsewhere). A second circuit board 78D-2 mounts the components of the latch sensor transmitter 82. These components include an antenna (not shown) that may be formed in the same manner as the antenna 80A, namely, as a printed trace on the circuit board 78D-2 or as a separately mounted component thereon (or elsewhere). A circuit board support member 86 is used to stack the circuit boards 78D-1 and 78D-2. The support member 86 may be formed from semi-rigid foam, plastic or other suitable material. Foam is advantageous because it helps provide impact resistance for the circuit boards 78D-1 and 78D-2 and the components thereon. As shown in FIG. 15, the foam may be extended in height slightly beyond the top of the transmitter housing base 78A to engage the transmitter housing cover 78B with slight compression. This will further isolate the circuit board components from impact forces. The connection block 84 can be mounted to the bottom transmitter housing base 78A in any suitable manner.

To provide tamper detection, a transmitter housing tamper sensor implemented as a plunger style switch 78E can be mounted to the first circuit board 78D-1 to detect when the transmitter housing cover 78B is removed. The transmitter 80 is programmed to generate a transmitter housing tamper signal if this occurs. This signal may be the same as or different than the manhole cover tamper signal generated when the tamper sensor switch units 40 are triggered. The tamper sensor switch 78E may include a spring member 78E-1 (see FIG. 17) to ensure proper engagement between the switch plunger and the transmitter housing cover 78B. As in the case of the tamper sensor switches 70 and 72 described above in connection with FIGS. 8-10, the tamper sensor switch 78E could also be implemented using other types of switches or sensors.

A separate battery housing 88 is mounted next to the transmitter housing 78. The battery housing 88 includes a base 88A and a removable cover 88B that may be joined together with screws or other fasteners 88C. Although not shown, a gasket seal may be disposed between the base 88A and the cover 88B to help provide the desired level of environmental protection. Like the transmitter housing 78, the battery housing 88 can be removably mounted on the second side 8 of the manhole cover body using screws 88A-1 or other fasteners to attach it to the second side itself or to other structure on that side of the manhole cover body 4 (such as the skid member 52). Within the battery housing 88, a battery holder 88D is provided for installing one or more batteries of any suitable type. FIG. 16 illustrates one possible embodiment wherein the battery holder 88A carries a premium 3 volt main battery 90 designed for long service life (e.g., 14 years or more for manhole cover security operations). The battery holder 88A is also capable of carrying two commodity batteries 92. The commodity batteries 92 could be 1.5 volt AA batteries that are wired in series to produce 3 volts. If desired, the main battery 90 and the commodity batteries 92 could be placed in service at the same time. In that case, the premium battery 90 and the two series-connected commodity batteries 92 could be wired to each other in parallel to provide redundancy and to increase the current available for powering the transmitters 80 and 82. Alternatively, the commodity batteries 92 need not be installed for operation in conjunction with the main battery 90. Instead, they could be reserved for emergency use and installed only if the main battery 90 fails and a replacement for the main battery is not readily available. Although not shown, a formed or cut foam insert may be placed over the batteries 90 and 92 to take up any space that could cause movement of items within the battery housing 88 due to dropping or inverting the manhole security cover 2.

The battery holder 88D-1 can be electrically connected to the connection block 84 in any suitable manner. FIG. 16 illustrates the use of a hollow wireway 94 extending between the transmitter housing base 78A and the battery housing base 88A for routing connector wires. The wireway 94 may be implemented as a hollow bolt and nut combination that fastens to the walls of the two housings. Alternatively, a hollow threaded tube extending through the housing walls and secured with nut fasteners could be used.

To provide tamper detection, a battery housing tamper sensor implemented as a plunger style switch 88E can be mounted to the battery holder 88D to detect when the battery housing cover 88B is removed. The tamper sensor switch 88E may have the same construction as the tamper sensor switch 78E used in the transmitter housing 78. It can be wired to the transmitter 80 (or to a separate transmitter) and the transmitter can be programmed to generate a battery housing tamper signal (which may be the same as or different than the manhole cover tamper signal generated when the tamper sensor switch units 40 are triggered). If desired, the tamper sensor switch 88E can be wired in series with the tamper sensor switch 78E in the transmitter housing. In that case, a generic housing tamper signal would be generated if either tamper sensor switch is activated. The wiring for the tamper sensor switch 78E can be routed through the above-described wireway 94 to the connection block 84.

Figure 18:
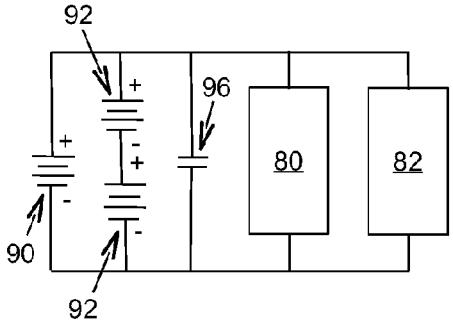
FIG. 18 is a schematic diagram showing an electrical circuit comprising transmitter and battery components as illustrated in FIG. 16.

The transmitters 80 and 82 would normally tend to draw power from the batteries 90 and/or 92 in short bursts as each transmitter powers up to a high power state in order to perform its programmed operations, such as sending a heartbeat signal. The transmitters 80 and 82 would then normally power down to a low power state (e.g., a sleep mode) to await the next high power state. In order to prolong battery life, and to also ensure that the transmitters 80 and 82 will operate at least temporarily in the event of a battery disconnection, a capacitor 96 or other charge storage device may be mounted on the connection block 84. Alternatively, one or more capacitors could be mounted on one or both of the circuit boards 78D-1 and 78D-2, or could be located in the battery housing 88. FIG. 17 shows the former embodiment, with the capacitor 96 being implemented as a large electrolytic capacitor that is mounted on the connection block 84. The capacitor 96 is wired in parallel with the batteries 90 and/or 92, and with the transmitters 80 and 82. In this circuit configuration, which is shown schematically in FIG. 18, the batteries 90 and/or 92 will continuously trickle-charge the capacitor 96 while the capacitor periodically discharges to supply energy to the transmitters 80 and 82 as they cyclically power up and down. This helps to prolong battery life insofar as the batteries 90 and 92 will typically last longer under a relatively steady load than they would with periodic pulse loads.

An advantage of the latch sensor embodiments of FIGS. 13-18 is that the manhole security cover 2 can notify of both a tamper-based situation (by way of a manhole cover tamper signal) as well as a legitimate keyed opening (by way of a manhole cover unlatching signal). This could be used to establish a two stage alarm/alert scenario. A first alarm would denote a keyed entry and a second alarm would denote the cover being lifted. The remote security system could be programmed so that the first alarm followed by the second alarm within a designated period of time is interpreted as an authorized access event. In contrast, the receipt of only the second alarm could be interpreted as an unauthorized access attempt.

Figure 19:
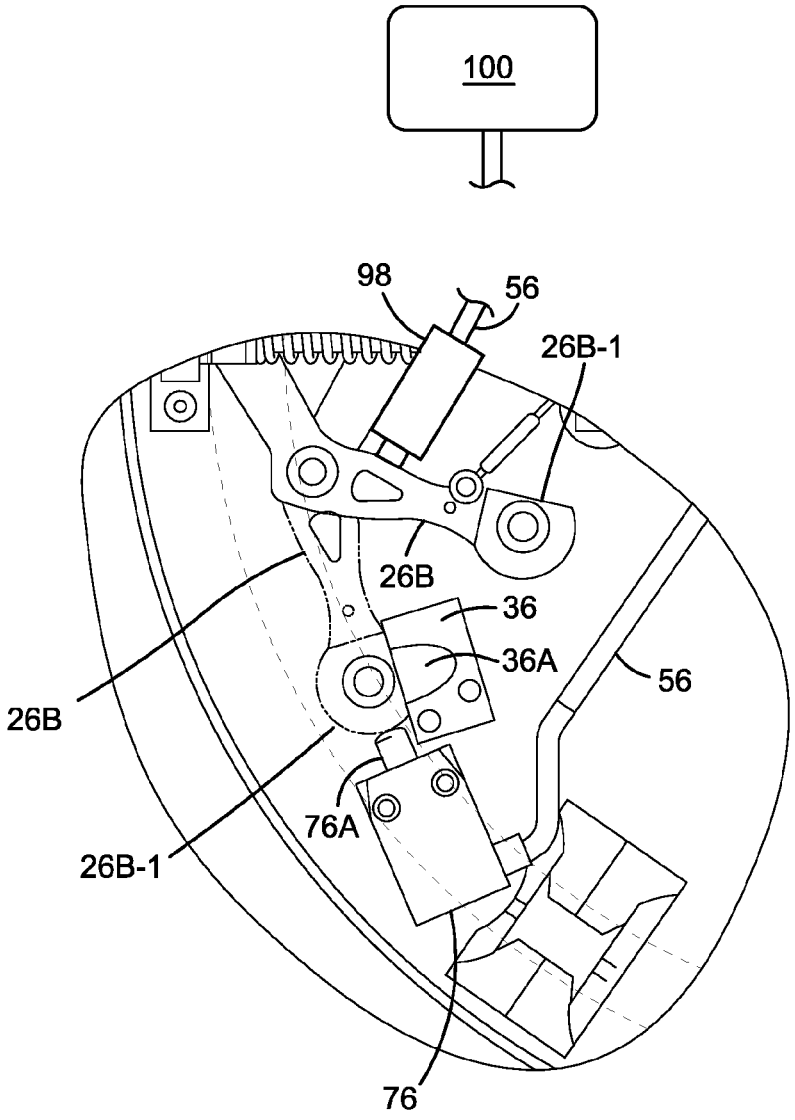
FIG. 19 is a fragmentary plan view showing a further modification of the manhole security cover of FIG. 1 wherein a latch actuator is provided for unlatching or unlocking a latch mechanism in response to a wireless signal.

Turning now to FIG. 19, a further modification of the manhole security cover 2 is shown in which an electromechanical latch actuator is mounted on the second side 8 of the manhole cover body 4 in order to actuate the latch mechanism 20 to its unlatched state. The latch actuator may be implemented in any suitable manner. The embodiment of FIG. 19 uses a plunger-style actuator 98 that is positioned to rotate the drive arm 26B of the latch drive unit 26 to its unlatched position. Although not shown, the latch actuator 98 could alternatively be positioned to actuate the drive arm 26A. In a further embodiment, a rotary actuator could be used in lieu of the latch actuator 98 to rotate the drive hub 26C.

The latch actuator 98 may be used to support a system and method for remote keyless entry to the manhole 14 by automatically unlatching the latch mechanism 20 in response to a wireless signal from a location outside the manhole (e.g., a key fob, a remote security system, etc.). To support such operation, the latch actuator 98 may be operatively coupled (e.g., via a two-pair wire 56) to a radio frequency receiver 100 mounted at a suitable location on the second side 8 of the manhole cover body 4. The receiver 100 may have programmed or hardwired logic to operate the latch actuator 98 in response to the reception of designated signal. Such a receiver may be implemented in any suitable manner. As previously mentioned for example, any of the above-described transmitters 60, 80 or 82 could be embodied as transmitter/receiver device that supports radio frequency signal reception in addition to radio frequency signal transmission. Alternatively, a stand-alone receiver could be added to one of the above-described housings 58, 68, 78 or 88, or a separate receiver housing (not shown) could be provided. Using a transmitter/receiver may reduce space and power requirements. In addition, a transmitter/receiver could be used to support additional functions, such as controlling other aspects of manhole security cover operation (e.g., remotely triggering additional devices such as alarms, cameras, environmental sensors, doors, valves, vents, etc.).

If desired, the embodiment of FIG. 19 could be modified to support a two-stage opening system and method. This could be done by changing the design of the latch actuator 98 so that it releasably locks and holds the latch drive unit 26 upon command from the receiver 100. Alternatively, a second latch actuator (not shown) could be used. When the latch drive unit 26 is locked by the latch actuator 98, it cannot be operated using a mechanical key. The latch actuator 98 must unlock and release the latch drive unit 26 before the key will work. Any suitable locking technique may be employed, such as actuating a movable pin or other element into interfering engagement with one of the moving components of the latch drive unit 26. During the first stage of opening, the latch actuator 98 would be commanded to release the latch drive unit 26 by sending a wireless signal to the receiver 100 from a location outside the manhole 14, such as a remote security system. Then a person on site would use a mechanical key to operate the latch drive unit.

As a further modification, the mechanical key that operates the latch mechanism 20 could be implemented as a "smart" key having an embedded circuit that supports wireless key identification. The key would communicate with a short-range receiver within the manhole security cover 2 using RFID or any other suitable communication technology. The required short-range receiving capability could be added to the receiver 100 or it could be provided using a separate receiver (not shown) that mounted near the latch actuator 98, or elsewhere. The short-range receiver would need to recognize the key in order for the latch actuator 98 to release the latch drive unit 26 so that the key will work. This embodiment not only adds a level of increased security but also can let remote personnel know who will be opening the manhole security cover 2. Certain personnel can be restricted from certain manhole security covers. Using the receiver 100, key authentication messages could be sent to the manhole security cover 2 from a remote location in order to update key security. This would add the ability to remotely allow a new key or disallow a previously authorized key if it is lost, thereby maintaining overall security and integrity. If desired, this embodiment may be used to extend the two-stage opening scheme described above to a three-stage scheme. The third stage would be an key authentication stage that takes place between the first remote unlocking stage and the final stage in which the key is used to mechanically unlatch the latch mechanism 20.

Figure 22:
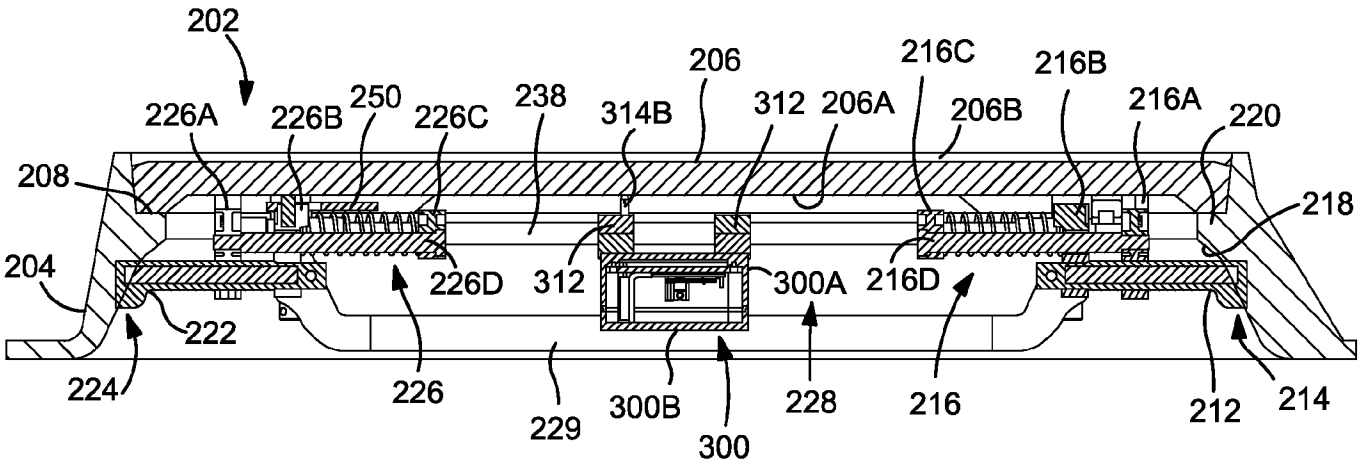
FIG. 22 is a cross-sectional centerline view of the manhole security cover of FIG. 20.

Turning now to FIGS. 20-26, a manhole security cover 202 according to a further example embodiment is illustrated. The manhole security cover 202 is configured to mount on a manhole frame 204 (see FIG. 22) and includes a self-locking manhole cover plate 206. The cover plate 206 has a lower side 206A and an upper side 206B. It is generally flat and can be made out of any suitable material that is of sufficient strength for the intended application and which is capable of passing RF radiation at frequencies of interest. For example, the cover plate 206 may comprise a material that is nonmetallic and corrosion-resistant, such as a polymer-based composite material (e.g. fiberglass, graphite-epoxy, etc.). As can be seen in FIG. 22, the cover plate 206 is adapted to rest on a manhole cover support surface 208 (typically a ring flange of the manhole frame 204). If desired, the thickness of the cover plate 206 can be larger around its periphery than its interior region. In FIG. 22, the lower side 206A of the cover plate 206 extends downwardly in the vicinity of the support surface 208 to form a peripheral flange. FIG. 22 also shows that the upper side 206B of the cover plate 206 is generally flush with a top portion 210 of the manhole frame 204 and a surrounding surface (not shown) in which the manhole frame is situated (e.g., a roadway, walkway, parking lot, etc.). As shown in FIG. 22, a latch 212 on the cover plate 206 is adapted to engage the manhole frame 204 at a first location 214 in a manner that resists lifting of the cover plate proximate to the first location.

The latch 212 may be constructed in various ways. In FIG. 22, the latch 212 is configured as a sliding pin or piston having a defined configuration. The latch 212 is supported by, and constitutes part of, a latch assembly 216 that may be mounted to the lower side 206A of the cover plate 206. The latch 212 engages an inwardly angled surface of the manhole frame 204 at the first location 214. This contact point is below a lip 218 formed on the underside of a ring flange 220 whose upper surface provides the manhole cover support surface 208. As will be described in more detail below, the latch 212 could also engage the lip 218 itself (which may be a more preferably contact point). The precise contact point of the latch 212 on the manhole frame 204 will be determined by frame geometry and the configuration of the manhole cover locking components. Alternatively, a precision mounting insert as shown in FIGS. 5, 5A and 5B could be used.

With continuing reference to FIG. 22, a second latch 222 (which may be identical in construction to the latch 212) is also disposed on the cover plate 206. The latch 222 engages the manhole frame 204 at a second location 224 that may be diametrically opposite to the first location 214 engaged by the latch 212. The latch 222 is supported by, and constitutes part of, a latch assembly 226 that may be mounted to the lower side 206A of the cover plate 206. The latch 222 engages an inwardly angled surface of the manhole frame at the second location 224. This contact point is below the lip 218 on the underside of the ring flange 220 (with other contact points also being possible). Thus, the latch 222 is adapted to engage the manhole frame 204 at the second location 224 in a manner that resists lifting of the cover plate 206 proximate to the second location. As described in more detail below, the latches 212 and 222 are operatively connected so that both components may be driven by a single latch drive unit and thereby retracted and disengaged from the manhole frame 204 in simultaneous fashion. In addition, the latch assembly 216 may be structurally connected to the latch assembly 226 to provide an integral latch mechanism 228 that can be mounted as a unit to the cover plate lower side 206A. A pair of generally U-shaped guard members 229 may also be mounted to the cover plate 206A to protect the components of the latch mechanism 228 from ground surface contact when the cover plate 206 is removed from the manhole frame 204.

Figure 23:
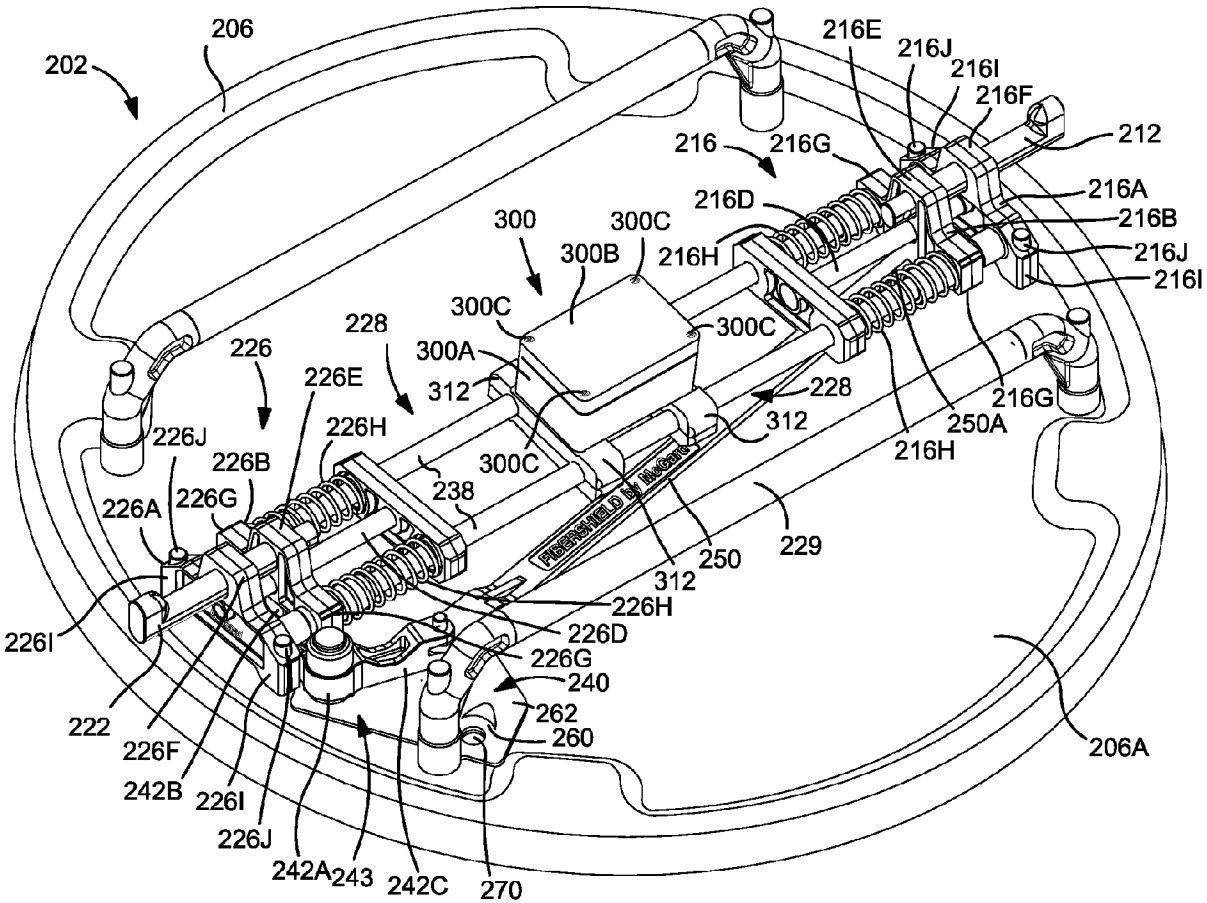
FIG. 23 is a perspective view of the manhole security cover of FIG. 20.

FIGS. 22-23 show the latch mechanism 228 in the locked position in which the latches 12/22 are fully extended. The latch assembly 216 that carries the locking member 212 has substantially the same construction as the latch assembly 226 that carries the locking member 222. Both mechanisms 216/226 respectively include a fixed front tower 216A/226A, a movable carriage 216B/226B, a rear tower 216C/226C, and a connector 216D/226D that may be implemented as a carriage bolt to interconnect the front and rear towers. The geometries and configurations of these components as shown in FIGS. 22-23 are for purposes of example only. Other component geometries and configurations could also be used according to design preferences and based on the materials used in their construction. The latches 212/222 are attached to the movable carriages 216B/226B of their respective latch assemblies 216/226. In particular, the latches 212/222 may be removably connected to a central apertured flange 216E/226E on the carriages 214B/226B. Each movable carriage 216B/226B functions as a latch support element. The latches 212/222 are also slidably supported by a central apertured flange 216F/226F on the front towers 216A/226A of each latch assembly 216/226. Each front tower 216A/226A thus also functions as a latch support element.

The movable carriage 216B/226B of each latch assembly 216/226 has a pair of apertured side flanges 216G/226G that are carried for sliding movement on a pair of bridge members 238 that interconnect the latch assemblies 216/226 to establish the latch mechanism 228. The bridge members 238 function as guide rods or shafts that stabilize the movable carriages 216B/226B and help to control and direct their movement. Each movable carriage 216B/226B is also carried for sliding movement on one of the connectors 216D/226D by way of an aperture in the central body portion of each movable carriage. This aperture is located at the intersection of the carriage flanges 216B/226B and 216E/226E. The connectors 216D/226D thus also function as guide rods or shafts for the movable carriages 216B/226B. On each latch assembly 216/226, the movable carriage 216B/226B is resiliently biased toward the front tower 216A/226A by a pair of coil springs 216H/226H. The coil springs 216H/226H mount on the bridge members 238 and extend between the movable carriage 216B/226B and the rear tower 216C/226C. Each front tower 216A/226A includes a pair of lateral mounting flanges 216I/226I that are used to secure the front towers to the cover plate lower side 206A, near the peripheral edge thereof. Within each lateral mounting flange 216I/226I is a through-bore (not shown) that may be formed with an upper counterbore to receive a fastener (not shown), such as a threaded screw or bolt, that attaches to the cover plate 6. To provide protection against corrosive agents, the fasteners may be sealed within their respective counterbores by way of sealing plugs 216J/226J. The ends of the bridge members 238 are anchored to the lateral mounting flanges 216I/226I of the front tower 216A/226A of each latch assembly 216/226. This creates a common interconnecting bridge structure that allows the latch mechanism 228 to be mounted as an integral unit to the cover plate lower side 206A. The bridge members 238 also extend through apertures in the rear towers 216C/226C, thus providing support for the rear towers.

A rotatable latch drive unit 240 is provided on the cover plate 206 to actuate the latches 212/222 against the force of the biasing mechanism provided by the springs 214H/226H. The latch drive unit 240 is similar in construction to the latch drive unit 26 previously described above. It includes a drive plate 242 having central hub 242A, a first drive arm 242B, and a second drive arm 242C. The first drive arm 242B functions to drive the latch assembly 226. In particular, it engages the movable carriage 226B. Rotation of the first drive arm 242B from its locking position to its unlocking position slides the movable carriage 226B toward the rear tower 226C. This retracts the latch 222 while compressing the springs 226H. The second drive arm 242C functions to drive the latch assembly 216. In particular, the end of the second drive arm 242C is rotatably pinned to a first end of a link member 250. A second end of the link member 250 extends under a portion of the latch assembly 216 (e.g., the rear tower 216C) and is pivotally connected to the movable carriage 216B. The movable carriage 216B may connect to the link member 250 by way of a pin (not shown) that slidably and rotatably engages a slot 250A formed at the second end of the link member 280. Rotation of the second drive arm 242C from its locking position to its unlocking position thus slides the movable carriage 216B toward the rear tower 216C. This retracts the locking member 212 while compressing the springs 216H.

The second drive arm 242C is arranged to engage a keeper 260 when it is rotated to its unlocking position. The keeper 260 may be formed as part of a thin flat base structure 262 that is mounted to the cover plate lower side 206A. As best shown in FIG. 23, the keeper 260 has a sloping ramp surface that angles upwardly from the main surface of the base structure 262 and then abruptly terminates at a keeper face. The face of the keeper 260 is adjacent to a cover plate access hole 270 that corresponds to the access hole 37 shown in FIG. 6. The keeper face captures the second drive arm 242C when the latch drive unit 240 is in its unlocking position. In this captured position, the second drive arm 242C cannot rotate back to the locking position, such that the latches 212/222 will remain their retracted (unlocked) position. Only by releasing the second drive arm 242C from the keeper 260 will the latches 212/222 be released to their extended (locked) position.

The latch drive unit 240 thus has a locking rotational position wherein the latches 212/222 are in their extended (locked) position, and an unlocking rotational position wherein the latches are in their retracted (unlocked) position. The latch drive unit 240 may be actuated in the same manner as the latch drive unit 26 described above. Thus, a lock aperture corresponding to aperture 27 shown in FIG. 6 may be provided at an off-center location on the cover plate 206. Seated in the lock aperture is a security lock, such as the lock L shown in FIG. 6, that is operatively connected to the latch drive hub 242A. Using a security key tool (not shown) to engage and rotate the security lock, the cover plate 206 can be unlocked when desired by retracting the latches 212/222 so that they disengage from their respective points of contact with the manhole frame 204, and so that they also clear the lip 218. This enables the cover plate 206 to be removed from the manhole frame 204 to allow access to the manhole access opening within. The access hole 270, which is disposed adjacent to the lock aperture, serves the same purpose as the access hole 37 shown in FIG. 6. In particular, it receives a release tool (not shown) that disengages the second drive arm 242C from the keeper 260. This releases the latch drive unit 240 from its latching position in order to return the latches 212/222 to their locked position.

Figure 24:
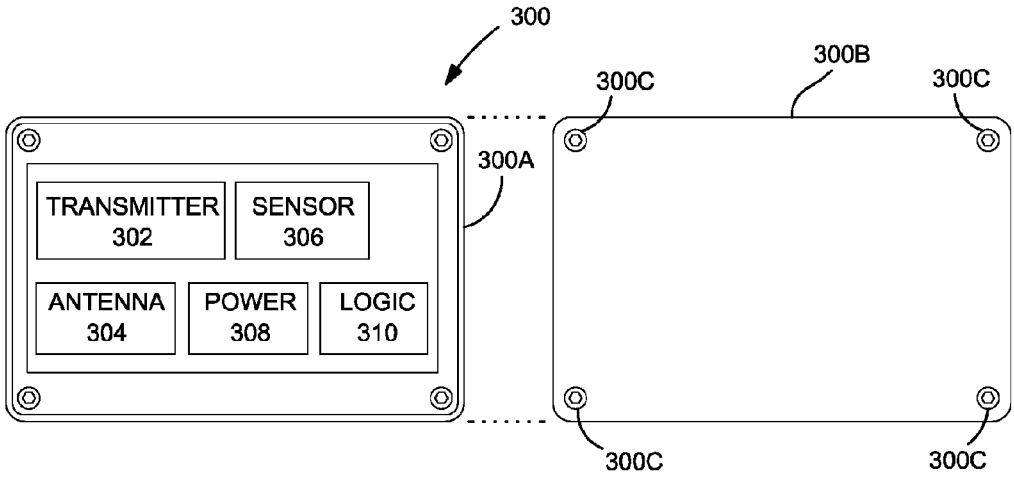
FIG. 24 is an functional block diagram view showing an example transmitter/antenna/sensor unit of the manhole security cover of FIG. 20.

With additional reference now to FIG. 24, the manhole security cover 202 additionally includes a transmitter/antenna/sensor (TAS) unit 300 mounted on the lower side 206A of the manhole cover body 206. As used herein, any reference to "mounting" an item "on" the lower side 206A of the manhole cover body 206 includes mounting the item directly to the lower side as well as mounting the item to another component on that side of the manhole cover body. For example, as discussed in more detail below, the TAS unit 300 may be mounted on the bridge members 238 of the latch mechanism 228. Alternatively, the TAS unit 300 could be mounted directly to the cover plate lower side 206A. However, the latter arrangement will require mounting holes in the manhole cover body 206 (assuming fasteners are used for the attachment). This may undesirably weaken the manhole security cover 202. The TAS unit 300 comprises one or more instances of an RF transmitter 302, an antenna 304, a manhole cover tamper sensor 306 and a battery power source 308. The transmitter 302, the antenna 304, the tamper sensor 306 and the power source 308 are all disposed within a single TAS housing having a TAS unit base 300A and a removable TAS unit cover 300B that may be joined together with screws or other fasteners 300C. Although not shown, a gasket seal may be disposed between the TAS unit base 300A and the TAS unit cover 300B to help provide a desired level of environmental protection.

In FIG. 24, each of the components in the TAS unit 300 is illustrated diagrammatically in a functional manner and not as the component would necessarily be physically configured in an actual implementation. This is because many different physical configurations, arrangements and numbers of components could be used. In general, the transmitter 302, the antenna 304 and the power source 308 may be constructed in any desired manner, including in accordance with any of the transmitters 60, 80, 82, antennas 62, 80A, and batteries 64, 90, 92 described above, respectively. The TAS unit housing may also be constructed in any desired manner, including in accordance with any of the transmitter housings 58, 68, 78, described above. As such, the TAS unit housing may also be referred to as a "transmitter housing." It should also be understood that the functions provided by the transmitter 302, the antenna 304, the power source 308, and the TAS unit housing may include some or all of the functions and features provided by corresponding components of the above-referenced embodiments. By way example only, and not by way of limitation, the transmitter 302 may have single-channel or multi-channel transmission capability as well as RF receiving capability, and may be constructed for operation at any suitable frequency range according to any suitable wireless digital (or analog) protocol, including but not limited to a cellular network protocol, a wireless network protocol, a proprietary protocol, etc. Encryption may also be supported. According to one example embodiment, the transmitter 302 could be implemented using a universal transmitter and receive from Inovonics of Louisville, Colo., operating within a range of approximately 850-950 MHz. The antenna 304 may be integrated on or off the transmitter circuit board and may have any suitable configuration that is compatible with the operational frequency and signal characteristics of the transmitter 302. The housing 308 may be formed as an industry-rated enclosure made from rigid plastic or other suitable material and may be optionally designed for protection from environmental exposure. The housing 308 may be of any suitable shape and size. It may also include tamper detection capability to detect when the housing unit cover 300B is removed from the housing unit base 300A. The power source 308 may have one or more batteries of any suitable number and type.

The tamper sensor 306 may also be implemented in a variety of ways, including as a single sensor or as a suite of sensors performing various functions. The tamper sensor 306 may employ such features as electronic movement and/or positioning technology. Electronic movement technology can be used to sense movement of the manhole security cover 202 in one or more directions, e.g., translation and rotation relative to an x-axis, a y-axis and/or a z-axis (in a Euclidean three-dimensional space), and may be provided by one or more movement detecting sensors, including but not limited to inertial (e.g., motion) sensors, tilt sensors, proximity sensors, and/or vibration sensors. Such sensors may be implemented using a variety of devices, such as accelerometers, gyroscopes, piezoelectric sensors, magnetic sensors, optical sensors, etc. These devices may be constructed using a variety of technologies, including but not limited to MEMS (Micro-ElectroMechanical Systems) technology. The one or more movement detecting sensors may be used alone or in combination, and may include single-function sensors and sensors that perform two or more sensing functions. Electronic positioning technology can be used to sense the position of the manhole security cover 202. Such technology may be provided by one or more position detecting sensors implemented using any of a variety of devices, such as one or more GPS units. The one or more position detecting sensors may be used alone or in combination, and may include single-function sensors and sensors that perform two or more sensing functions. The tamper sensor 306 may also include other sensing technologies in addition to those mentioned above, including but not limited to environmental sensing, heat/smoke/fire sensing, etc.

The TAS unit 300 further includes one or more instances of programmable or hardwired TAS unit logic 310 whose functions include sensor control logic for processing sensor inputs and distinguishing between actual manhole cover tamper events and non-tamper-related events. For example, based on testing and experimentation, the TAS unit logic 310 could program the TAS unit 300 to distinguish valid tamper events from one or more non-tamper-related conditions. This may be necessary so that the TAS unit 300 does not respond to ambient "noise" due to normal forces and movements experienced by the manhole security cover 202 while it is in service. For example, a manhole cover used for a roadway application will typically experience deflections and vibrations due to the weight of overhead vehicles, impacts and other traffic-related conditions. Examples of ambient conditions that might be experienced by the manhole security cover 202 include, but are not limited to:

(1) cover deflection due to vehicle drive-over and park-on events;

(2) cover bounce due to drive-over events;

(3) cover rotation caused by drive-over events;

(4) cover vibration due to drive-over events and drive-near events.

The TAS unit logic 310 may be implemented in various ways, including as part of a stand-alone component, as part of the transmitter 302 (e.g., a programmable transmitter or transmitter/receiver), as part of the tamper sensor 306, or as some combination of the foregoing. In order for the TAS unit 300 to distinguish between genuine tamper events and non-tamper-related events (such as those listed above), the TAS unit logic 310 may include appropriate programming, circuitry, and/or mechanical control elements to adjust the sensitivity of the tamper sensor 306, and set its detection thresholds. This functionality may include establishing a home position following installation of the manhole security cover 206 on the manhole frame 4.

The TAS unit logic 310 may be set up so that the tamper sensor 306 will detect the manhole security cover 202 being translated or rotated a threshold distance from the home position. By way of example only, the threshold distance for vertical translations could be equal to the thickness of the manhole cover body 206. This would cause an alarm to be generated if an unauthorized attempt is made to lift the cover enough so that a harmful instrumentality or agent could be dropped into the underlying manhole. If desired, different thresholds could be set for different translation directions and for rotational movement. Depending on the sensing device(s) present in the tamper sensor 306, the TAS unit logic 310 could also include an auto-leveling feature for establishing a home position of the manhole security cover 206 when it is installed at a non-horizontal grade angle. Any threshold-exceeding rotation of the manhole security cover 206 from this home position may then be interpreted as a tamper event. Acceleration and velocity thresholds could also be established, particularly to detect intrusion attempts wherein the manhole cover body 206 is moved very slowly in at attempt to avoid detection.

Figure 25:
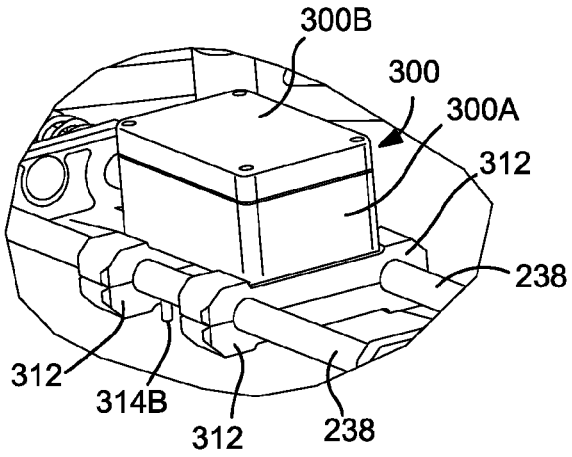
FIG. 25 is fragmentary perspective view showing the transmitter/antenna/sensor unit in an example mounting configuration.
Figure 26:
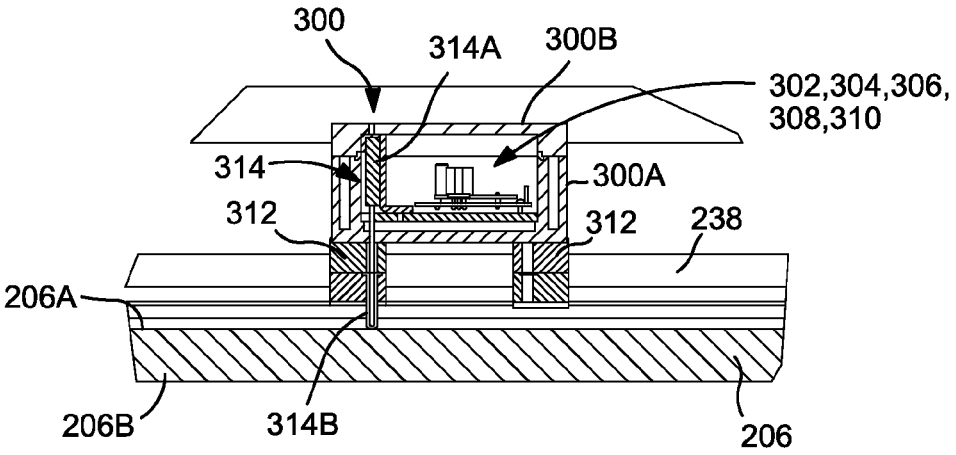
FIG. 26 is a fragmentary cross-sectional view showing the transmitter/antenna/sensor unit in the example mounting configuration of FIG. 25.

The ability to distinguish between tamper events and non-tamper-related events can be enhanced by mounting the TAS unit 300 on the bridge members 238 of the latch mechanism 228, rather than directly to the cover plate lower side 206A. If a different latch mechanism configuration is used, the TAS unit 300 could be mounted to any suitable non-moving portion thereof. Mounting the TAS unit 300 on the latch mechanism 228 makes the TAS unit 300 less sensitive to cover deflections because the TAS unit is not in direct contact with the manhole cover body 206. Moreover, the bridge members 238 are supported by the latch assemblies 216 and 226, which are secured to the manhole cover body 206 near its periphery. The periphery of the manhole cover body 206 experiences less deflection than the center of the manhole cover body due to the periphery being supported on the manhole frame 204 and comprising a relatively rigid peripheral flange. As best shown in FIGS. 25 and 26, the TAS unit 300 may be mounted to the bridge members 238 using removable clamp members 312 that are attached to the bottom of the TAS unit base 300A. This mounting arrangement of the TAS unit 300 allows it to be retrofitted to existing manhole covers that have bridge member (or similar) components. If desired, the clamp members 312 may include gasketed surfaces for vibration isolation and sealing. Each clamping member 312 includes an upper and lower clamp element. The clamp elements may be secured together using suitable fasteners (not shown).

Figure 20:
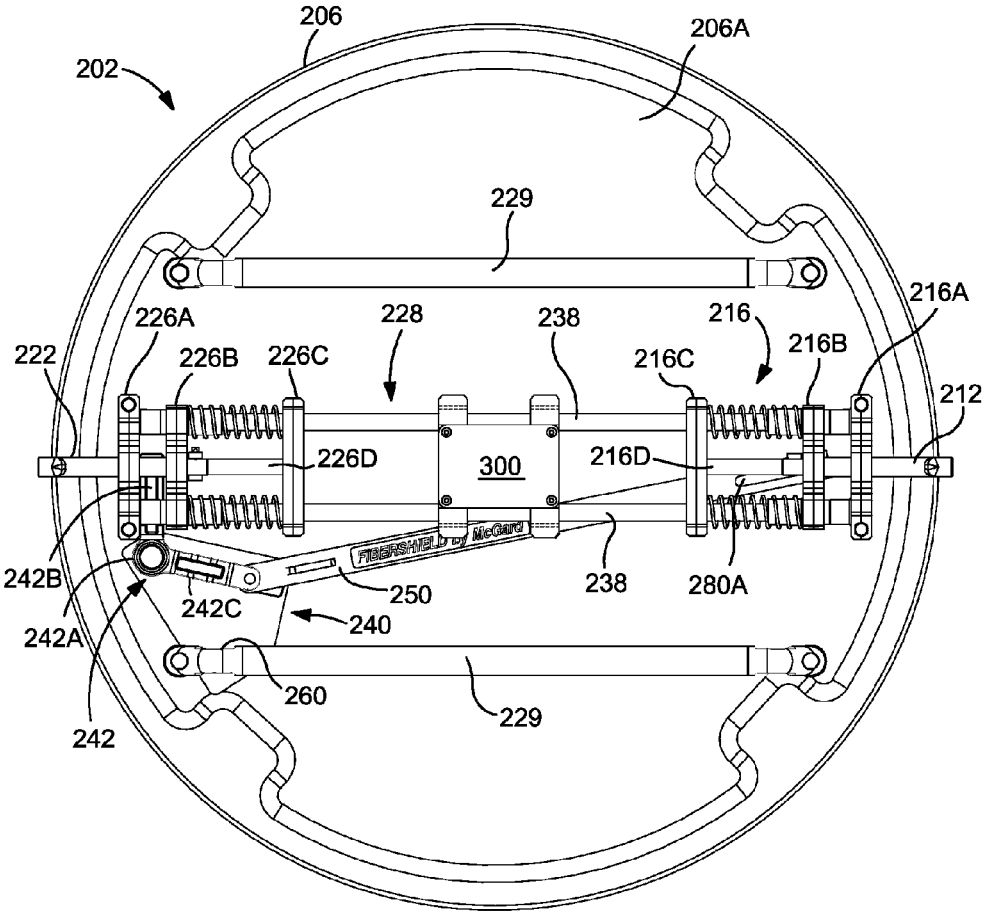
FIG. 20 is a plan view showing a manhole security cover according to another example embodiment.
Figure 21:
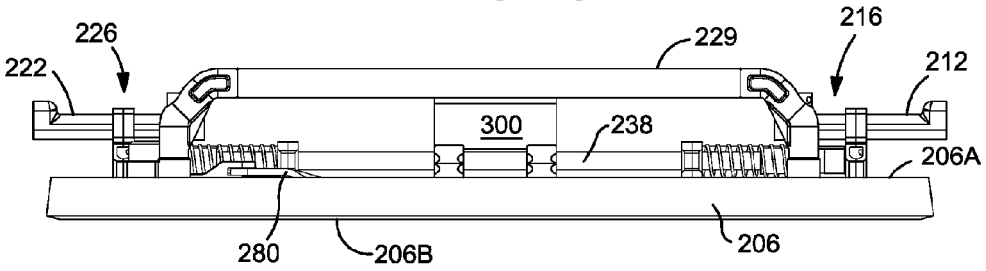
FIG. 21 is a side view of the manhole security cover of FIG. 20.

It will also be seen in FIGS. 20 and 23 that the TAS unit 300 is mounted at a location that is proximate to the link member 250 of the latch mechanism 240. Due to this proximity, the tamper sensor 306 may be provided with additional sensing capability for detecting latch mechanism movement and generating an unlatching signal. For example, the tamper sensor 306 may include a proximity sensing device (e.g., a reed switch, a Hall-effect sensor, etc.) in order to detect such movement. This will support a two-stage alert wherein receipt of the unlatching signal within a predetermined time period prior to receipt of the manhole cover tamper signal enables a determination of whether removal of the manhole security cover from the manhole opening is authorized. The same effect could be achieved by mounting the TAS unit 300 in close proximity to some other moving component of the latch mechanism 204, such as one of the latch assemblies 216 or 226. Although not shown, it will be appreciated that the manhole security cover 206 may be configured with a latch mechanism actuator and the TAS unit 300 may be configured to support remote unlatching and keyless entry, as well as latch mechanism remote locking/locking to support key authentication. For these applications, the transmitter 302 will include RF receiver functionality, as described above in connection with earlier embodiments.

A further advantage of mounting the TAS unit 300 on the bridge members 238 is that an optional cover deflection sensor may be used to detect deflections of the manhole cover body 206. An example cover deflection sensor 314 is illustrated in FIGS. 22, 25 and 26. It is implemented as a linear motion potentiometer that is connected in an electrical circuit pathway and includes a sensor body 314A and a sensor plunger 314B. Other sensing devices may also be used, including but not limited to magnetic potentiometers, reed-type switches, non-contact linear magnetic encoders, etc. The sensor body 314A is disposed within the TAS unit base 300A. The sensor plunger 314B extends through a opening in the bottom of the TAS unit base 300A. This opening may be sealed to keep moisture and other contaminants out of the TAS housing 300. The length of the sensor plunger 314B is selected so that its tip is in contact with the cover plate lower side 206A. When the manhole cover body 206 is deflected downwardly due to a vehicle drive-over or park-on event, the bridge members 238 will not experience the same degree of deflection due to the manner in which they are mounted (see above). Thus, deflection of the manhole cover body 206 will change its spacing relative to the bridge members 238. This change in spacing will depress the sensor plunger 314B, thereby changing the deflection sensor's potentiometer resistance. Following the vehicle drive-over or park-on event, the manhole cover body 206 will rebound upwardly toward its home position, and may pass upwardly beyond the home position due to oscillatory motion caused by inherent spring forces within the manhole cover body. The changes in resistance caused by downward and upward deflections of the manhole cover body 206 will produce corresponding changes in electrical circuit voltage that may be used to represent a cover deflection signal that corresponds to the magnitude and direction of deflection. The cover deflection signal may be used by the TAS unit logic 310 to distinguish between a tamper event (which would not normally produce cover deflections) and a non-tamper-related condition such as a drive-over or park-on event (which will produce cover deflection). The deflection sensor 314 may also be used to detect the manhole security cover's deflection recovery after a park-on event. For example, after an extended park-on event, the manhole cover body 106 may not immediately return to 100% of its original undeflected position. Instead, the manhole cover body 106 may initially recover only 90-95% (for example) and then gradually recover the remaining 5-10% (for example) and eventually return to its original state over a longer period of time. The TAS unit logic 310 may then be programmed to compensate for such deflection recovery so that a false alarm is not triggered. For example, after an initial partial deflection recovery, the TAS unit logic 310 could deem the manhole cover body 206 to be in an "armed" condition but would allow further deflection recovery without triggering an alarm signal.

Accordingly, a manhole security cover with wireless manhole security functionality has been disclosed. Manhole cover installations and operational methods were also disclosed and form part of the inventive subject matter. Although example embodiments have been shown and described, it should be apparent that many variations and alternative embodiments could be implemented in accordance with the teachings herein. For example, the disclosed embodiments illustrate manhole security covers 2 and 202 that are intended to cover a manhole opening in a roadway, parking lot, or other area where motor vehicles are present. To that end, the respective manhole cover bodies 4/206 of each manhole security cover 2/202 are designed as a load-bearing structure that can support the weight of an overhead vehicle, including a tractor trailer or other heavy equipment weighing several tons, in the event that a wheel of the vehicle is parked thereon. The manhole security covers 2/202 are further designed to be completely detached from the manhole opening and set aside when entry into the manhole is desired. Other embodiments of a manhole security cover could be designed for manholes that are in structures that do not carry vehicle traffic, such as tanks, towers, vaults and the like. In such installations the manhole cover body may not need to be a load-bearing structure, particularly if the manhole opening is on a sidewall of the structure. Moreover, the manhole cover body could be designed to remain attached to the manhole opening, such as by adding hinge mounts instead of using the hingeless manhole security cover design shown in the illustrated embodiments. It is understood, therefore, that the invention is not to be in any way limited except in accordance with the spirit of the appended claims and their equivalents.

What is claimed is:

1. A manhole security cover for covering an opening to a manhole, comprising:

a manhole cover body comprising a non-metallic RF signal transmissive material;

said manhole cover body having a generally planar first side, a second side spaced from said first side and a peripheral edge portion;

said manhole cover body being operatively positionable during use thereof to seat on a manhole frame and cover said manhole opening, such that said first side of said manhole cover body is accessible from outside said manhole, said second side of said manhole cover body is disposed within said manhole, and said peripheral edge portion of said manhole cover body engages a manhole cover support surface on said manhole frame;

a manhole cover tamper sensor responsive to a predetermined movement of said manhole security cover body;

a transmitter operatively connected to said manhole cover tamper sensor and configured to generate a radio frequency manhole cover tamper signal when said manhole cover tamper sensor detects said predetermined movement of said manhole security cover body;

an antenna operatively coupled to said transmitter to radiate radio frequency energy through said manhole cover body to a receiver located outside of said manhole; and said transmitter, said antenna and said tamper sensor being enclosed within a single transmitter/antenna/sensor (TAS) unit on said second side of said manhole cover body.

2. The manhole security cover of claim 1, wherein said TAS unit comprises a TAS housing having a TAS base and a TAS cover.

3. The manhole security cover of claim 1, wherein said tamper sensor comprises technology selected from the group consisting of electronic movement technology and electronic positioning technology.

4. The manhole security cover of claim 3, wherein said electronic movement technology is selected from the group consisting of inertial sensors, tilt sensors, proximity sensors, and/or vibration sensors.

5. The manhole security cover of claim 3, wherein said electronic positioning technology is selected from the group consisting of GPS devices.

6. The manhole security cover of claim 1, wherein said TAS unit comprises sensor control logic for distinguishing between actual manhole cover tamper events and non-tamper-related events.

7. The manhole security cover of claim 6, wherein said sensor control logic comprises programming, circuitry, and/or mechanical control elements to adjust a sensitivity of said tamper sensor and/or set its detection thresholds.

8. The manhole security cover of claim 7, wherein said sensor control logic is operable to establish a home position following installation of the manhole security cover on a manhole frame.

9. The manhole security cover of claim 8, wherein sensor control logic comprises an auto-leveling feature for establishing said home position when said manhole security cover is installed at a non-horizontal grade angle.

10. The manhole security cover of claim 8, wherein said sensor control logic is operable to detect said manhole security cover being moved a threshold distance from said home position, said sensor control logic utilizing one or more threshold distances to monitor translation in one or more directions, rotation in one or more directions, or both.

11. The manhole security cover of claim 10, wherein said sensor control logic utilizes a threshold distance for vertical movement of said manhole security cover that is equal to a thickness of said manhole cover body, such that an alarm may be generated if an unauthorized attempt is made to lift said manhole security cover enough so that a harmful instrumentality or agent could be dropped into said manhole opening.

12. The manhole security cover of claim 8, wherein sensor control logic is operable to provide an auto-leveling feature for establishing said home position when said manhole security cover is installed at a non-horizontal grade angle.

13. The manhole security cover of claim 1, further including:

a key-actuated latch mechanism operable to engage and lock said manhole cover body to said manhole frame, said latch mechanism comprising one or more retractable latches on said second side of said manhole cover body and a latch drive unit, said latch drive unit being operatively coupled to said latches and accessible on said first side of said manhole cover body for engagement by a security key; and said TAS unit being mounted on a non-moving part of said latch mechanism at a location that is spaced from said second side of said manhole cover body in order to reduce false alarms caused by deflection of said manhole cover body.

14. The manhole security cover of claim 12, wherein said tamper sensor comprises a cover deflection sensor operable to sense cover deflections.

15. The manhole security cover of claim 14, wherein said cover deflection sensor comprises a linear sensing device that maintains contact with said manhole cover body.

16. The manhole security cover of claim 15, wherein said tamper sensor comprises a latch mechanism sensor operable to sense latch mechanism movement.

17. The manhole security cover of claim 16, wherein said transmitter is configured to generate a manhole cover latching signal when said latch mechanism sensor senses said latch mechanism being latched or unlatched, said TAS unit supporting a two-stage alert wherein receipt of an unlatching signal within a predetermined time period prior to receipt of a tamper signal enables a determination of whether removal of said manhole security cover from said manhole opening is authorized or unauthorized.

* * * * *